US007747200B2

(12) United States Patent
Eto

(10) Patent No.: US 7,747,200 B2
(45) Date of Patent: Jun. 29, 2010

(54) IMAGE FORMING APPARATUS WITH TONER CONTAINER ATTACHABLE IN PLURAL DIRECTIONS

(75) Inventor: Daisuke Eto, Osaka (JP)

(73) Assignee: Kyocera Mita Corporation (JP)

( * ) Notice: Subject to any disclaimer, the term of this patent is extended or adjusted under 35 U.S.C. 154(b) by 227 days.

(21) Appl. No.: 11/891,202

(22) Filed: Aug. 9, 2007

(65) Prior Publication Data

US 2008/0038023 A1 Feb. 14, 2008

(30) Foreign Application Priority Data

Aug. 10, 2006 (JP) ..... 2006-217812

(51) Int. Cl.
*G03G 15/08* (2006.01)

(52) U.S. Cl. ..... 399/263

(58) Field of Classification Search ..... 399/119, 399/223, 258, 262, 263
See application file for complete search history.

(56) References Cited

U.S. PATENT DOCUMENTS 5,489,976 A * 2/1996 Ichikawa ..... 399/263
6,246,854 B1 * 6/2001 Kurosawa et al. ..... 399/263
7,116,925 B2 * 10/2006 Yamaguchi ..... 399/262 X

FOREIGN PATENT DOCUMENTS

| | | |
|---|---|---|
| JP | 2001-356548 | 12/2001 |
| JP | 2004-317883 | 11/2004 |
| JP | 2004-333929 | 11/2004 |

* cited by examiner

*Primary Examiner*—Sandra L Brase
(74) *Attorney, Agent, or Firm*—Gerald E. Hespos; Michael J. Porco

(57) ABSTRACT

An image forming apparatus includes a main body, a developing device, and a toner container. The toner container is attachable to and detachable from the main body, and a rotating shaft is installed in the interior thereof. A first joint is on one end of the toner container and is coupled to the rotating shaft. A second joint is provided to the main body opposite the first joint. A coupling guide mechanism couples the first and second joints to each other, and a driving source transmits a driving force to the first joint via the second joint. The coupling guide mechanism couples the first joint and the second joint to each other whether the toner container is loaded into the main body in an axial direction or in a radial direction of the rotating shaft.

7 Claims, 9 Drawing Sheets

IMAGE FORMING APPARATUS WITH TONER CONTAINER ATTACHABLE IN PLURAL DIRECTIONS

BACKGROUND OF THE INVENTION

1. Field of the Invention

The present invention relates to an image forming apparatus, and more particularly, to an attaching and detaching structure of a toner container loaded attachably and detachably in the apparatus main body of an image forming apparatus.

2. Description of the Related Art

In order to replenish the developing device installed inside the apparatus main body of an image forming apparatus with a developer, there has been known a toner container loaded attachably and detachably in the apparatus main body (including the developing device). The method of inserting and removing the toner container in and from the apparatus main body includes the longitudinal inserting and removing method by which the toner container is inserted in and removed from the apparatus main body in a vertical direction and the lateral inserting and removing method by which the toner container is inserted in and removed from the apparatus main body in a horizontal direction.

Which method should be adopted is determined on the basis of the type of image forming apparatus, for example, whether the image forming apparatus is used as a copying machine or as a printer, the layout of various members installed inside the apparatus main body, and so forth.

For example, in a case where the image forming apparatus is a printer, the longitudinal or lateral inserting and removing method, whichever suits the circumstances better is used. On the contrary, in the case of a copying machine equipped with an automatic document reading device that automatically reads document images of documents one by one from a pile of documents, because the automatic document reading device and the scanner portion are provided in the top portion of the apparatus main body, it is normal to adopt the lateral inserting and removing method by which the toner container is inserted in and removed from the apparatus main body from the front surface thereof. This is attributed to the difficulty to configure the automatic document reading device and the scanner portion, which are heavy loads, to be openable with respect to the top surface of the apparatus main body.

In a case where the longitudinal inserting and removing method is adopted, as a transmission method of transmitting a driving force from the apparatus main body to the developer stirring mechanism in the toner container, it is normal to adopt the method of allowing the gears on the respective sides to space apart from and come closer to each other. On the contrary, in a case where the lateral inserting and removing method is adopted, so-called coupling to allow the cups to space apart from and come closer to each other is often adopted.

Incidentally, as an image forming apparatus adopting the longitudinal inserting and removing method, the one described, for example, in JP-A-2004-317883, has been known. As an image forming apparatus adopting the lateral inserting and removing method, those described, for example, in JP-A-2004-333929 and JP-A-2001-356548, have been known.

Conventionally, toner containers for exclusive use are manufactured for an image forming apparatus of interest depending on the toner container inserting and removing method, more specifically, whether the image forming apparatus adopts the longitudinal inserting and removing method or the lateral inserting and removing method.

Hence, a toner container manufactured for an image forming apparatus adopting, for example, the longitudinal inserting and removing method is not applicable to an image forming apparatus adopting the lateral inserting and removing method, and conversely, a toner container manufactured for an image forming apparatus adopting the lateral inserting and removing method is not applicable to an image forming apparatus adopting the longitudinal inserting and removing method. Hence, in an event that there is a discrepancy from the output schedule due to the movement of demand, oversupplied toner containers for the image forming apparatus adopting one method cannot be diverted to those in short supply for the image forming apparatus adopting the other method, that is, it is impossible to interchange toner containers between the two methods.

It is therefore necessary to manufacture toner containers for exclusive use for an image forming apparatus adopting each method to meet the movement of demand. To this end, manufacturing lines for two systems have to be installed to manufacture toner containers for exclusive use for each method. This raises a problem that not only the cost of facilities and the cost of manufacturing are proportionately increased, but also the cost of inventory is increased.

SUMMARY OF THE INVENTION

An object of the invention is to provide an image forming apparatus having an attaching and detaching structure for a toner container having compatibility between the inserting and removing methods so as to be adaptable to various types of image forming apparatus.

In order to achieve the above and other objects, an image forming apparatus according to an aspect of the invention includes: an apparatus main body; a developing device installed inside the apparatus main body; a toner container provided attachably to and detachably from the apparatus main body to replenish the developing device with a developer; a rotating shaft installed in the toner container to be rotatable; a first joint member provided on one of end portions of the toner container and coupled to the rotating shaft; a second joint member provided to the apparatus main body oppositely to the first joint member; a coupling guide mechanism that couples the first and second joint members to each other; and a driving source equipped to the apparatus main body to generate a specific driving force, wherein the driving force of the driving source is transmitted to the first joint member via the second joint member while the first and second joint members are coupled to each other by the coupling guide mechanism, and the coupling guide mechanism couples the first joint member and the second joint member to each other whether the toner container is loaded into the apparatus main body in an axial direction or in a radial direction of the rotating shaft.

DETAILED DESCRIPTION OF THE PREFERRED EMBODIMENTS

Figure 1A:
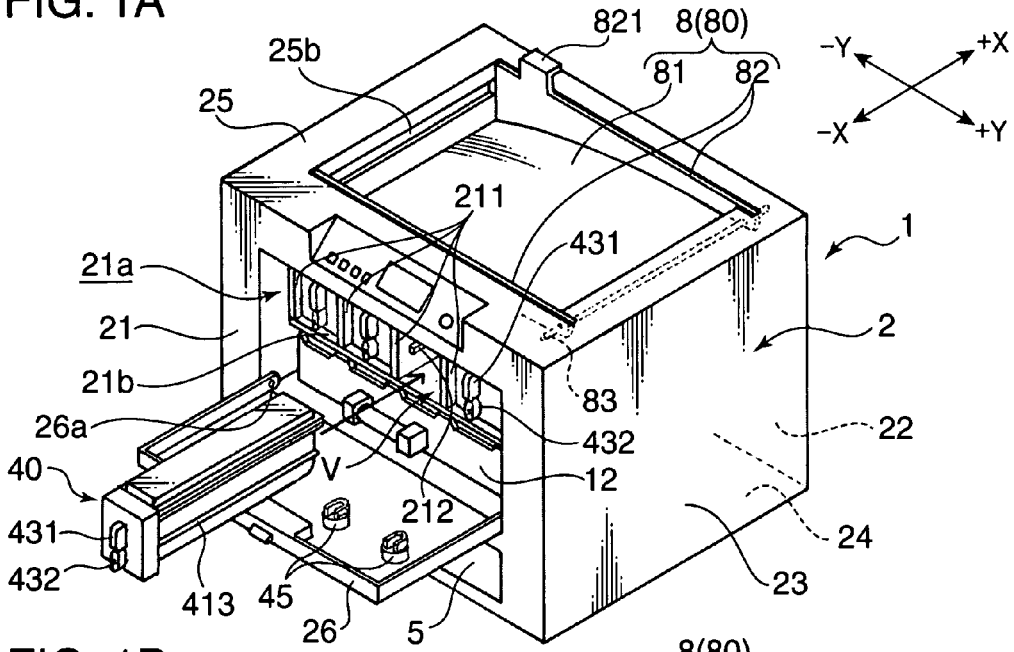
FIGS. 1A and 1B are perspective views showing a printer according to a first embodiment of the invention, FIG. 1A showing a state where a toner container is being loaded in the printer from the left surface side of the printer and FIG. 1B showing a state where the toner container is being loaded in the printer from the top surface side of the printer.
Figure 1B:
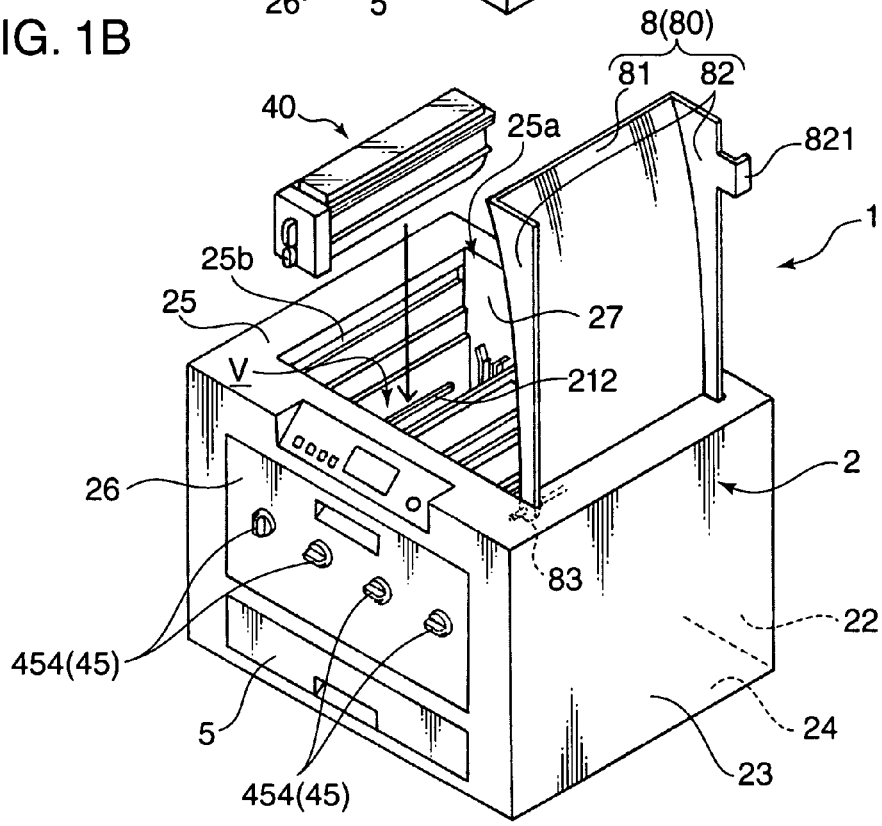

FIGS. 1A and 1B are perspective views showing a printer according to a first embodiment of the invention. FIG. 1A shows a state where a toner container is being loaded in the printer from the left surface side of the printer and FIG. 1B shows a state where the toner container is being loaded in the printer from the top surface side. In FIGS. 1A and 1B, the X-X direction is defined as the right-left direction and the Y-Y direction is defined as the front-back direction. In particular, the −X direction is defined as leftward, the +X direction as rightward, the −Y direction as frontward, and +Y direction as rearward.

FIGS. 1A and 1B show a color printer as a printer (image forming apparatus) 1. The printer 1 is formed by installing various members for image formation inside a printer main body 2 (apparatus main body) in the shape of a rectangular prism like a box. The printer main body 2 includes a left surface plate 21 covering the left surface, a right surface plate 22 covering the right surface, a pair of side plates 23 in front and rear covering the front and the rear, a bottom plate 24 covering the bottom surface, and a top plate 25 covering the top surface, all of which are fixed to an unillustrated frame.

The left surface plate 21 is provided with a maintenance opening 21*a* through which members (an image forming unit 12 and toner containers 40 described below) are inserted in and removed from the inside at substantially the upper half position, and a maintenance door 26 to open and close the maintenance opening 21*a*. The maintenance door 26 is axially supported at the lower edge portion so as to be rotatable about a supporting shaft 26*a* provided to the frame and extending in the front-rear direction, and is thus able to change the posture between a closing posture (FIG. 1B) to close the maintenance opening 21*a* and an opening posture (FIG. 1A) to open the maintenance opening 21*a*.

A partition wall 21*b* that divides a space inside the printer main body 2 corresponding to the maintenance opening 21*a* to a top half and a bottom half is provided at the back of the maintenance opening 21*a*. Four toner containers 40 are loaded in an insertible and removable manner on top of the partition plate 21*b*.

Five dividing plates 211 to divide the space above the partition plate 21*b* into four parts are provided to stand on the top surface of the partition plate 21*b*. A loading space V in which to load each toner container 40 (toner containers 40M, 40C, 40Y, and 40K) is defined between every pair of mutually opposing dividing plates 211. The top of the loading space V is normally closed by a sheet discharge tray 80 (FIG. 1A), and it is open when the sheet discharge tray 80 is opened (FIG. 1B). Hence, by opening the sheet discharge tray 80, it is possible to insert and remove the toner container 40 in and from the loading space V in the top-bottom direction via a top plate opening 25*a*.

In this embodiment, a toner container 40M for magenta filled with magenta toner particles, a toner container 40C for cyan filled with cyan toner particles, a toner container 40Y for yellow filled with yellow toner particles, and a toner container 40K for black filled with black toner particles are adopted as the four toner containers 40. They are separately loaded into the loading spaces V defined between every pair of mutually opposing dividing plates 211 on the partition plate 21*b* from the rear to the front in the order specified above.

An image forming unit 12 in which are installed various members for image formation is provided under the partition plate 21*b* in an insertible and removable manner. The image forming unit 12 will be schematically described below with reference to FIG. 2.

A sheet feeding cassette 5 for storing a pile of sheets, P1, made of plural stacked sheets P is provided to the printer main body 2 in an insertible and removable manner at a position lower than the maintenance door 26 on the left surface plate 21.

The top plate opening 25*a* (FIG. 1B) of a rectangular shape is made in the top plate 25, and a sheet discharge portion 8 onto which a sheet P done with the image forming processing is discharged is provided so as to close the top plate opening 25*a*. The sheet discharge portion 8 is provided with the sheet discharge tray 80 that closes the top plate opening 25*a* in an openable and closable manner. The sheet discharge tray 80 includes a tray main body 81 that receives a sheet P discharged from a sheet discharge port 25*b* that opens in the wall surface in front of the top plate opening 25*a*, and a pair of side wall plates 82 on right and left provided to stand up from the right and left edge portions of the tray main body 81.

The tray main body 81 is formed in a convex arc shape inclined to point upward from the front edge toward the rear. This configuration makes it possible to receive a sheet P discharged from the sheet discharge port 25*b* appropriately.

A pair of the side wall plates 82 is of a shape set so that the lower edge portions go along the arc shape of the tray main body 81 and the top edge surfaces are flush with the top plate 25 while the posture of the sheet discharge tray 80 is set to the closing posture. Each side wall plate 82 is axially supported at the rear edge portion in FIG. 1A to be rotatable about a supporting shaft 83 provided to a specific frame of the printer main body 2 and extending in the right-left direction. The sheet discharge tray 80 is able to change the posture between the closing posture shown in FIG. 1A and the opening posture shown in FIG. 1B by being rotated in forward and backward directions about the supporting shaft 83.

In this embodiment, an L-shaped handle 821 is provided at the front position in the top ridge portion of the side wall plate 82 on the right. The user is able to open and close the sheet discharge tray 80 easily by holding the L-shaped handle 821.

By adopting a toner container attaching and detaching structure 50 of this embodiment, not only can the toner containers 40 be inserted in and removed from the printer main body 2 from sideway as is shown in FIG. 1A, but also they can be inserted in the printer main body 2 from above and removed therefrom upward as is shown in FIG. 1B.

Figure 2:
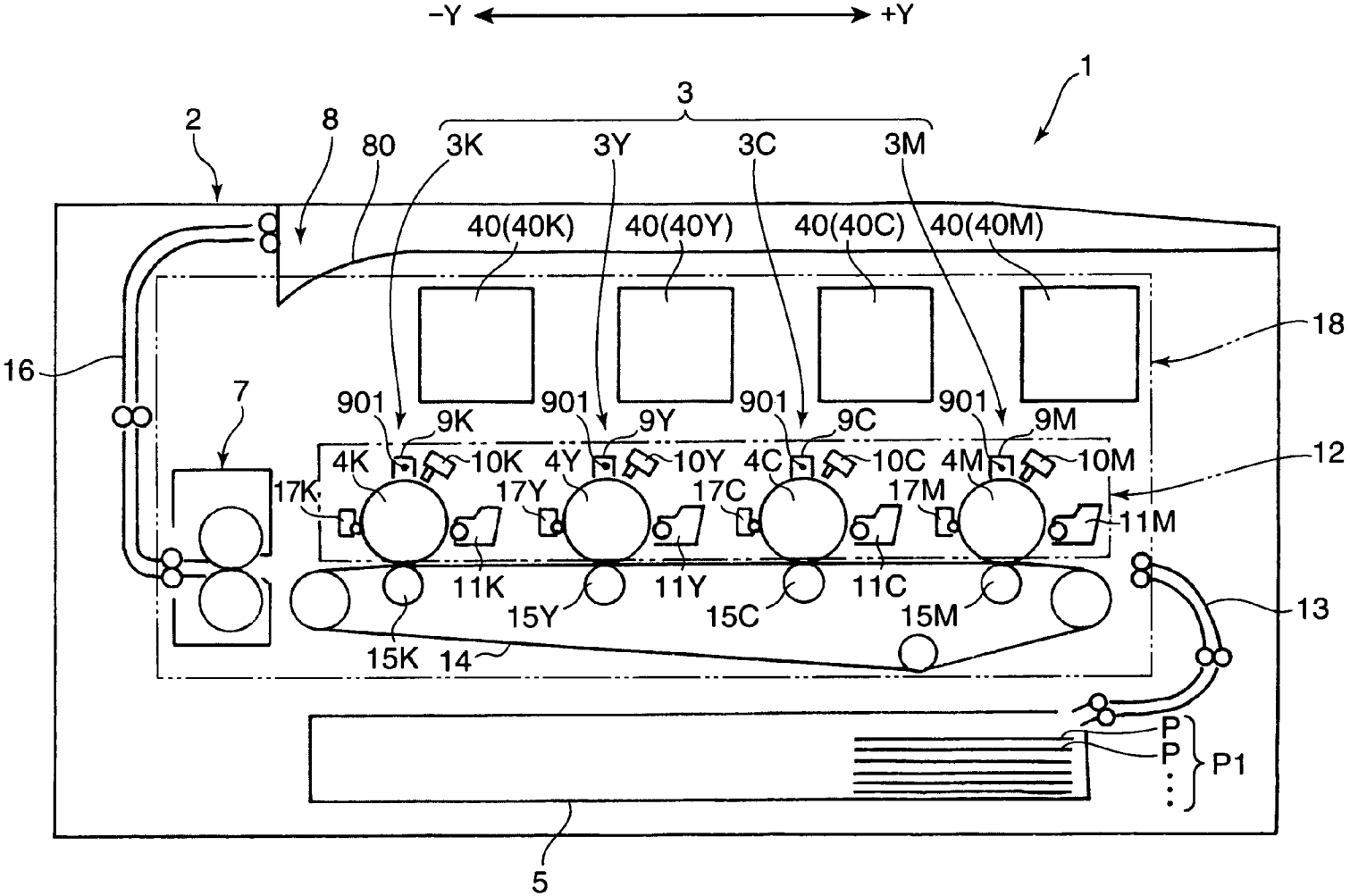
FIG. 2 is a side view in section used to schematically describe the internal structure of the printer.

FIG. 2 a side view in section used to schematically describe the internal structure of the printer 1. The indication of direction using a capital Y in FIG. 2 is the same as in FIGS. 1A and 1B, that is, (−Y: frontward, +Y: rearward). Also, in FIG. 2, members allocated for magenta, cyan, yellow, and black, capitals M, C, Y, and K are attached to the numerals specifying the corresponding members, so that which member corresponds to which developer can be recognized.

Four image forming portions 3, more specifically, an image forming portion 3M for magenta, an image forming portion 3C for cyan, an image forming portion 3Y for yellow, and an image forming portion 3K for black, are provided in the printer main body 2 sequentially from the upstream side (rear side). The respective image forming portions 3M, 3C, 3Y, and 3K form images in different four colors in each process including charging, exposing, developing, and transferring processes.

Photoconductive drums 4M, 4C, 4Y, and 4K serving as exclusive-use image carriers are provided to the image forming portions 3M, 3C, 3Y, and 3K, respectively. Toner images formed on these photoconductive drums 4M, 4C, 4Y, and 4K are transferred onto a sheet P transported from the sheet feeding cassette 5. Subsequently, fixing processing by heating is applied to the sheet P bearing transferred toner images in a fixing portion 7, and the sheet P on which the toner images are fixed is discharged to the sheet discharge portion 8. Incidentally, all the photoconductive drums 4M, 4C, 4Y, and 4K apply image forming processing on each sheet P while they rotate in a clockwise direction in FIG. 2.

The image forming portions 3 will now be described. The image forming portions 3M, 3C, 3Y, and 3K are equipped, respectively, with the photoconductive drums 4M, 4C, 4Y, and 4K provided to be driven so as to rotate about the drum center when driven by unillustrated driving mechanisms. Charging devices 9M, 9C, 9Y, and 9Y, in each of which a charging wire 901 is stretched across, are disposed at the upper positions of the image forming portions 3M, 3C, 3Y, and 3K, respectively. Also, exposing devices 10M, 10C, 10Y, and 10K that apply exposing processing, respectively, to the photoconductive drums 4M, 4C, 4Y, and 4K by irradiation of LED light according to image information are provided in close proximity to the surfaces of the photoconductive drums 4M, 4C, 4Y, and 4K, respectively.

Initially, the surfaces of the photoconductive drums 4M, 4C, 4Y, and 4K are electrically charged uniformly by means of corona discharge from the charging wires 901 in the corresponding charging devices 9M, 9C, 9Y, and 9K. Subsequently, by being exposed to irradiated light by the exposing devices 10M, 10C, 10Y, and 10K, electrostatic latent images according to image signals are formed on the peripheral surfaces of the respective photoconductive drums 4M, 4C, 4Y, and 4K.

Developing devices 11M, 11C, 11Y, and 11K are provided at positions right behind the photoconductive drums 4M, 4C, 4Y, and 4K, respectively. The developing devices 11M, 11C, 11Y, and 11K are filled with developers in magenta, cyan, yellow, and black (a mixture of toner particles and a carrier in the case of a two-component developer, and toner particles in the case of a mono-component developer) replenished from the toner containers 40M, 40C, 40Y, and 40K, respectively.

When a shortage in amount of toner particles in the developing devices 11M, 11C, 11Y, and 11K is detected by unillustrated toner sensors, the developers are replenished to the developing devices 11M, 11C, 11Y, and 11K from the containers 40M, 40C, 40Y, and 40K, respectively. The developers in respective colors are supplied to the peripheral surfaces of the photoconductive drums 4M, 4C, 4Y, and 4K by the developing devices 11M, 11C, 11Y, and 11K, respectively. Visible images (toner images) are thus formed according to the electrostatic latent images that have been formed on the peripheral surfaces of the photoconductive drums 4M, 4C, 4Y, and 4K through exposure to light by the exposing devices 10M, 10C, 10Y, and 10K, respectively.

Sheets P onto which to transfer toner images are accommodated in the sheet feeding cassette 5 in the form of a pile of sheets, P1. Each of sheets P extracted one by one from the sheet feeding cassette 5 is guided by a sheet feeding guide 13 and transported toward the respective photoconductive drums 4M, 4C, 4Y, and 4K while it is placed on the surface of a transfer belt 14 that circulates in a counterclockwise direction. A sheet made of resin, which is a dielectric material, is adopted as the transfer belt 14.

When the transfer belt 14 starts to circulate, a sheet P is transported on the transfer belt 14 while being guided by the sheet feeding guide 13. In this instance, image formation is performed at specific timing in the image forming portion 3M for magenta located in uppermost stream, and an image is formed on the photoconductive drum 4M. Subsequently, when the sheet P passes by directly below the photoconductive drum 4M for magenta, the image (toner image in magenta) formed on the photoconductive drum 4M is transferred onto the sheet P by the transfer roller 15M.

The sheet P is next transported to the following image forming portion 3C for cyan by the transfer belt 14. As with the image forming portion 3M for magenta, when the sheet P passes by directly below the photoconductive drum 4C for cyan, the image (toner image in cyan) formed on the photoconductive drum 4C is transferred onto the sheet P by the transfer roller 15C. Thereafter, when the sheet p passes directly below the photoconductive drums 4Y and 4K for yellow and black, images in the corresponding colors (toner images in yellow and black) are sequentially transferred onto the sheet P by the transfer rollers 15Y and 15K, respectively, in the same manner as above. The respective images in the four colors (magenta, cyan, yellow, and black) transferred onto the sheet P have been formed with a specific positional relation pre-determined with respect to the sheet P for the purpose of full-color image formation.

The sheet P on which are transferred the toner images in the respective four colors is separated from the transfer belt 14 and transported to the fixing portion 7. The toner particles in the four colors forming the full color image on the sheet P undergo fixing processing by heating when the sheet P passes by the fixing portion 7. Thereafter, the sheet P is discharged onto the sheet discharge tray 80 of the sheet discharge portion 8 by a sheet discharge guide 16. Toner particles remaining on the respective photoconductive drums 4M, 4C, 4Y, and 4K after the transferring are removed by corresponding cleaning devices 17M, 17C, 17Y, and 17K, so that the respective photoconductive drums 4M, 4C, 4Y, and 4K are prepared for the subsequent latent image formation.

In this embodiment, the components described above are unitized in the image forming unit 12 (indicated by a chain double-dashed line in FIG. 2). More specifically, all the photoconductive drums 4M, 4C, 4Y, and 4K, all the charging devices 9M, 9C, 9Y, and 9K, all the exposing devices 10M, 10C, 10Y, and 10K, all the developing devices 11M, 11C, 11Y, and 11K, and all the cleaning devices 17M, 17C, 17Y, and 17K are installed inside the image forming unit 12. By inserting and removing the image forming unit 12 in and from the printer main body 2 while the maintenance door 26 is open, it is possible to pull out all the members for image formation, such as the photoconductive drums 4M, 4C, 4Y, and 4K respectively forming the image forming portions 3M, 3C, 3Y, and 3K, integrally from the printer main body 2. This configuration makes it easier to perform maintenance work for the image forming portions 3.

Figures 3A, 3B, 3C:
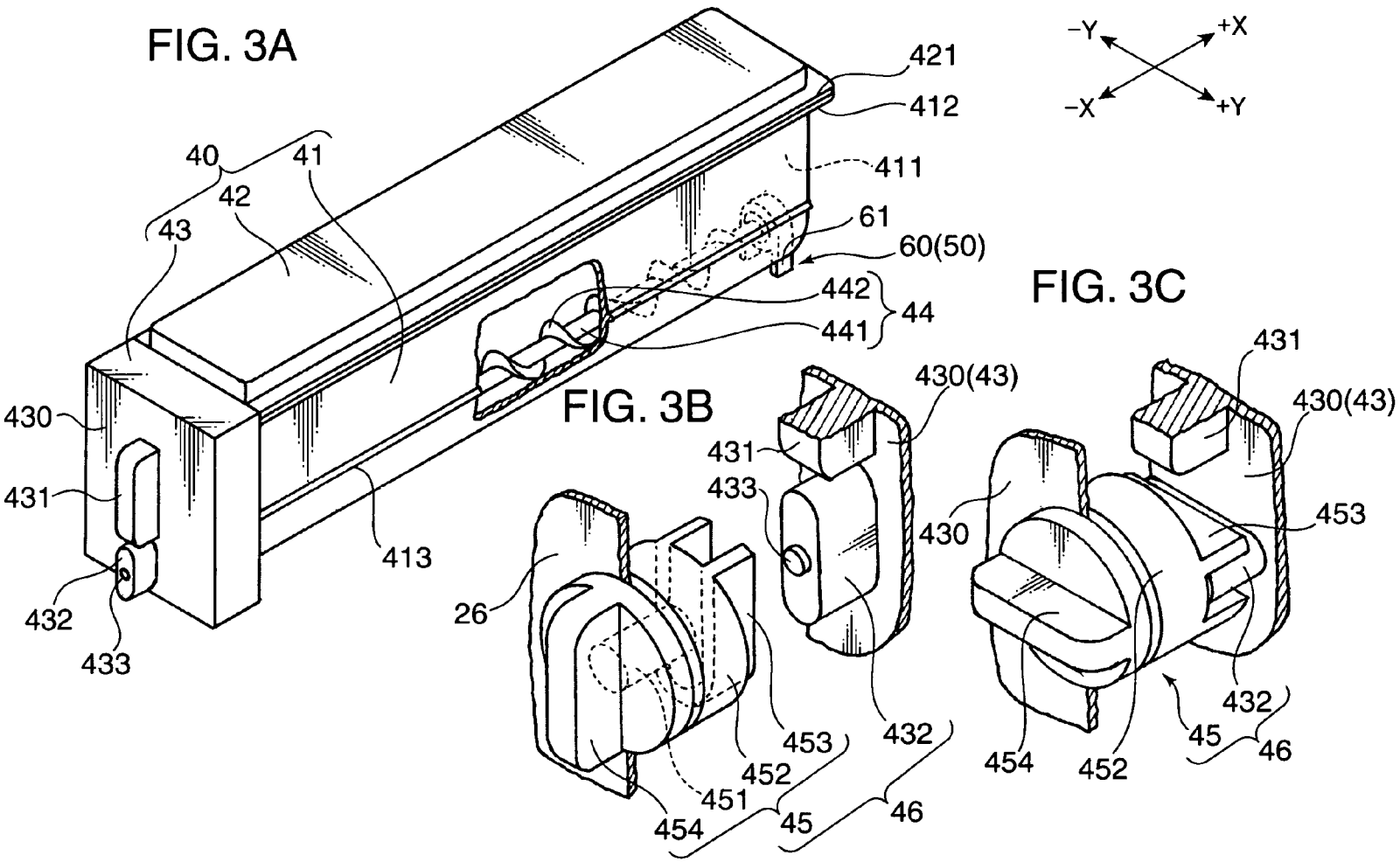
FIGS. 3A through 3C are perspective views showing one embodiment of the toner container, FIG. 3A being a partially notched perspective view of the toner container and FIGS. 3B and 3C being enlarged perspective views of a locking piece as a component forming the toner container.

Hereinafter, the toner containers 40 (all the toner containers 40M, 40C, 40Y, and 40K are of the same specification) will be described with reference chiefly to FIGS. 3A through 3C and to FIGS. 1A and 1B and FIG. 2 when the need arises. FIGS. 3A through 3C are perspective views showing one embodiment of the toner container 40. FIG. 3A is a partially notched perspective view of the toner container 40 and FIG. 3B and FIG. 3C are enlarged perspective views of a locking piece 432 as a component forming the toner container 40. FIG. 3B shows a state where the locking piece 432 is released from the locking and FIG. 3C shows a state where the locking piece 432 is locked up.

As is shown in FIG. 3A, the toner container 40 is provided with a container main body (housing) 41 filled with a developer, a top surface lid 42 that closes the top surface opening of the container main body 41, and a side surface lid 43 that closes the left surface opening of the container main body 41. A right side plate 411 is provided on the right end face of the container main body 41.

For the container main body 41, the length is set to be long in the right-left direction to match the right-left length across the loading space V, and the front-rear width dimension is set to be slightly narrower than the inner dimension between every pair of the mutually opposing dividing plates 211. Also, for the container main body 41 together with the top surface lid 42 to be accommodated in the loading space V, the top-bottom dimension of the container main body 41 is set so that the size including the top surface lid 42 is slightly smaller than the top-bottom dimension across the loading space V.

The container main body 41 is of a U-shape when viewed in the section in the right-left direction, and has a spiral feeder 44 extending in the right-left direction at a position slightly above the inner bottom portion. The spiral feeder 44 has a feeder shaft (rotating shaft) 441 installed across a space between the right side plate 411 of the container main body 41 and the side surface lid 43, and a spiral fin 442 provided concentrically and integrally with the feeder shaft 441. The spiral fin 442 rotates as the feeder shaft 441 rotates about the shaft center when driven by a driving motor 79 (driving source, see FIG. 4A). The developer inside the container main body 41 is then transported toward the side surface lid 43 while being stirred by rotations of the spiral fin 442.

A main-body-side flange 412 is provided on the top edge portion of the container main body 41. A lid-side flange 421 corresponding to the main-body-side flange 412 is provided on the bottom edge portion of the top surface lid 42. The interior of the toner container 40 is sealed hermetically by joining these flanges 412 and 421 via a bonding agent while the developer is filled in the container main body 41 to which the side surface lid 43 is attached on the left end portion.

A pair of guided strips 413 protruding in directions opposite to each other and extending in the right-left direction is provided on the outer side surfaces at front and rear of the container main body 41. Guide rails 212 corresponding to the respective guided strips 413 and extending in the right-left direction are provided on the opposing surfaces of every pair of the mutually opposing dividing plates 211. The toner container 40 is pushed in while the respective guided strips 413 are supported on the corresponding guide rails 212.

An unillustrated developer delivery port and a container-side shutter that opens and closes the developer delivery port are provided in close proximity to the side surface lid 43 at the bottom of the container main body 41. Meanwhile, a developer reception port corresponding to the developer delivery port and an apparatus-main-body-side shutter that opens and closes the developer reception port are provided to the partition plate 21*b* in the loading space V in the printer main body 2. It is configured in such a manner that both the container-side shutter and the apparatus main-body-side shutter are opened by pushing the toner container 40 into the loading space V either from sideway or above, while both the container-side shutter and the apparatus main-body-side shutter are closed by pulling out the toner container 40 from the loading space V in either direction.

The developer delivered from the toner container 40 to the printer main body 2 side via the developer delivery port and the developer reception port is replenished to the corresponding developing device 11M, 11C, 11Y, or 11K that needs replenishing via a specific channel.

Further, a container-side joint member 60 (first joint member) as a component forming the toner container attaching and detaching structure 50 is provided to the outer surface side of the right side plate 411 of the container main body 41. Also, the printer main body 2 is provided with a printer-side joint member 70 (second joint member) opposing the container-side joint member 60. The container-side joint member 60 and the printer-side joint member 70 will be described below in detail.

The side surface lid 43 is set to a dimension larger than the left end face so as to be able to close the opening of the left end face of the container main body 41, and the outer dimension of the front-rear width is set to be slightly narrower than the inner dimension of every pair of the mutually opposing dividing plate 211 on the printer main body 2 side. Hence, by pushing the toner container 40 into the loading space V, the side surface lid 43 is pinched by a corresponding pair of the mutually opposing dividing plates 211 via a slight clearing. The toner container 40 is thus positioned in the front-back direction inside the printer main body 2.

The side surface lid 43 is provided with a clipping piece 431 long in the top-bottom direction, which is provided at the center position of the left surface plate 430 to protrude leftward. The toner container 40 is inserted in and removed from the loading space V in the printer main body 2 while the clipping piece 431 is clipped by a user.

The locking piece 432 to lock the toner container 40 in the loaded state in the loading space V is provided at the position directly below the clipping piece 431 on the left surface plate 430 of the side surface lid 43. The locking piece 432 is made of a small plate piece, and a through-hole penetrating through in the right-left direction is made at the center position thereof. Meanwhile, a protruding shaft 433 protruding leftward is provided at the position directly below the clipping piece 431 on the left surface plate 430 of the side surface lid 43. The locking piece 432 is attached to the protruding shaft 433 to be rotatable about the protruding shaft 433 as the through-hole thereof is externally fit on the protruding shaft 433 in a state so as not to come off.

The maintenance door 26 (FIG. 1, FIG. 3B, and FIG. 3C) is provided with a locking operation member 45 at the position corresponding to the locking piece 432. The locking operation member 45 is formed by including a penetrating shaft 451 that penetrates through the maintenance door 26, a disc plate 452 fixed concentrically with the penetrating shaft 451 at the right end portion thereof, a U-shaped piece 453 formed integrally with the disc plate 452 in the shape of a capital U on the right surface of the disc plate 452 oppositely to the locking piece 432, and an operation dial 454 fixed to the left end portion of the penetrating shaft 451 via the maintenance door 26.

The penetrating shaft 451 is set so that it is positioned concentrically with the protruding shaft 433 of the locking piece 432 while the maintenance door 26 is closed. For the U-shaped piece 453, the dimension and the set position to the disc plate 452 are set so that it is externally fit on the locking piece 432 while the maintenance door 26 is closed (FIG. 1A). In this embodiment, a locking structure 46 is formed of the locking piece 432 and the locking operation member 45.

According to the locking structure 46 as above, as is shown in FIG. 3B, immediately before the maintenance door 26 is closed, the U-shaped piece 453 of the locking operation member 45 is in a state where it opposes the locking piece 432 in the unlocked posture extending in the top-bottom direction on the left surface plate 430 of the side surface lid 43. By closing the maintenance door 26 completely in this state, the U-shaped piece 453 of the locking operation member 45 externally fits on the locking piece 432 of the side surface lid 43.

By turning the operation dial 454 of the locking operation member 45 about the penetrating shaft 451 by 90° in a clockwise direction in this state, the locking piece 432 rotates together with the U-shaped piece 453 about the protruding shaft 433, and as is shown in FIG. 3C, it lies on its side while enfolded in the U-shaped piece 453. An upward movement of locking piece 432 is thus blocked by the U-shaped piece 453 lying on its side, which brings the toner container 40 into a locked state so as not to come off upward.

Figure 4A:
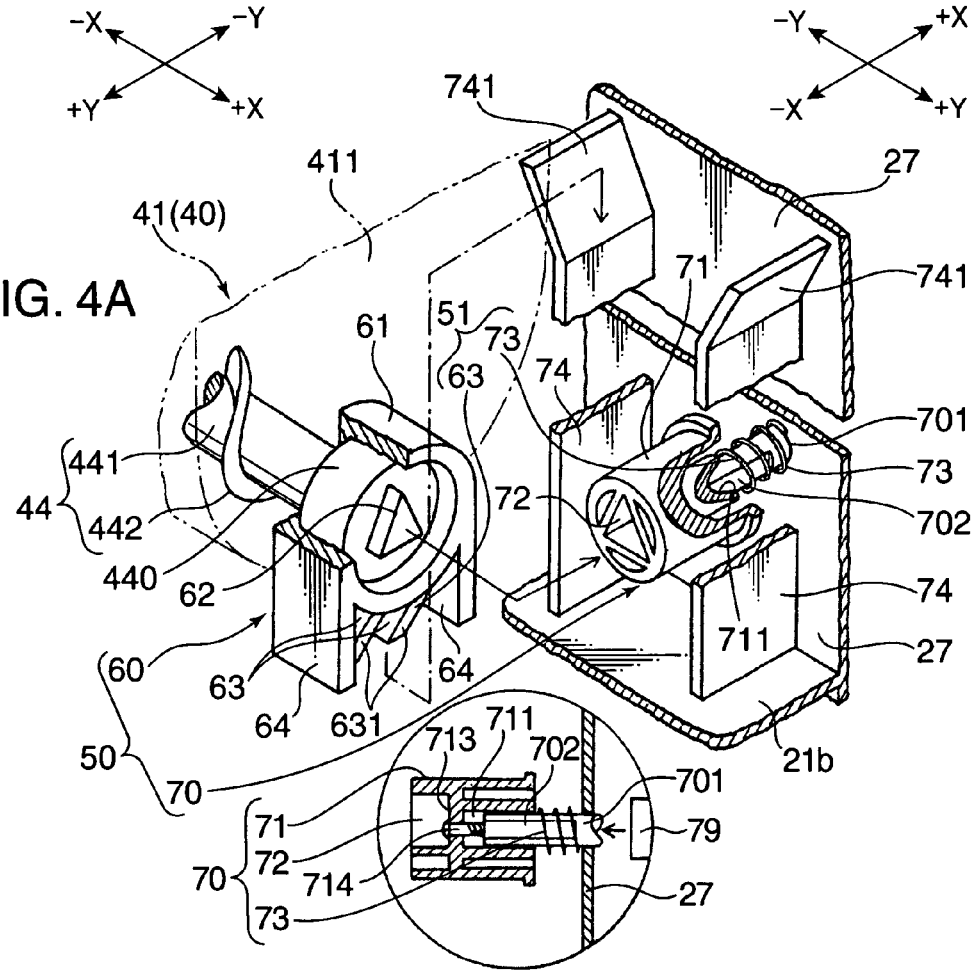
FIGS. 4A and 4B are perspective views showing one embodiment of a toner container attaching and detaching structure, FIG. 4A showing a state where a container-side joint member and a printer-side joint member are not coupled to each other and FIG. 4B showing a state where the both are coupled to each other.
Figure 4B:
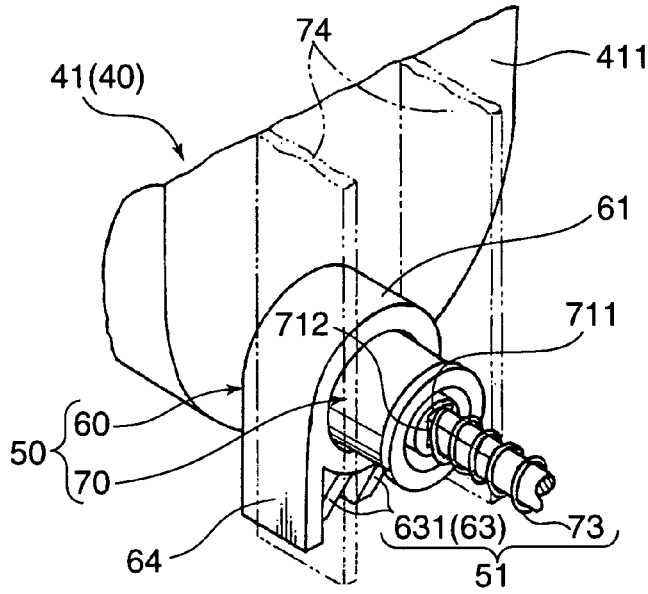

The toner container attaching and detaching structure 50 of this embodiment will now be descried with reference to FIGS. 4A and 4B. FIGS. 4A and 4B are perspective views showing one embodiment of the toner container attaching and detaching structure 50. FIG. 4A shows a state where the container-side joint member 60 and the printer-side joint member 70 are not coupled to each other and FIG. 4B shows a state where the container-side joint member 60 and the printer-side joint member 70 are coupled to each other. The inset in FIG. 4A is a cross section of the printer-side joint member 70. The indication of direction using capitals X and Y in FIGS. 4A and 4B is the same as in FIGS. 1A and 1B, that is, (X is the right-left direction (−X: leftward, +X: rightward) and Y is the front-rear direction (−Y: frontward, +Y: rearward)).

The toner container attaching and detaching structure 50 is formed by including the container-side joint member 60 (first joint member) formed at the bottom end portion of the right plate 411 of the container main body 41, and the printer-side joint member 70 (second joint member) attached to a back plate 27 provided at the back of the loading space V in the printer main body 2 (rightward in FIG. 1A).

The container-side joint member 60 includes an outer tube 61, a triangular key (coupling key) 62, pressing pieces 63 (a part of a coupling guide mechanism), and guided plate pieces 64 (a part of the coupling guide mechanism).

The outer tube 61 is formed integrally with the right plate 411, and is externally fit, in a sliding contact state, on the feeder shaft (rotating shaft) 441 protruding leftward by penetrating through the right plate 411 of the container main body 41. In other words, the end portion of the feeder shaft 441 is internally fit in the outer tube 61.

The triangular key 62 is a protrusion formed on the end face of the feeder shaft 441 concentrically with the feeder shaft 441 in the shape of a regular triangle when viewed in the end face. This embodiment shows an example where the triangular key 62 is formed on the end face of a column-shaped shaft head 440 having a larger diameter than the feeder shaft 441 (incidentally, the shaft head 440 is a part of the feeder shaft 441) that is formed integrally and concentrically with the feeder shaft 441 on the right end face thereof. The triangular key 62 is accommodated within an inner space of the outer tube 61. More specifically, the right end face of the triangular key 62 is positioned slightly leftward from the right end face of the outer tube 61 and thereby comes inside the outer tube 61.

The pressing pieces 63 are members provided to protrude downward from the outer peripheral surface of the outer tube 61 so as to press an inner tube 71 described below. The guided plate pieces 64 are a pair of members in front and rear provided to extend downward on the outer side in the radial direction from the front-rear position of the peripheral surface of the outer tube 61.

In this embodiment, the pressing pieces 63 are provided in a pair in front and rear in a space between a pair of the guided plate pieces 64. An inclined surface 631 inclined leftward as the right edge surface extends downward from the right end face of the outer tube 61 (that is, inclined to point downward toward the base end of the outer tube 61 from the tip end edge of the outer tube 61) is formed in each pressing piece 63.

The printer-side joint member 70 includes the inner tube 71, a triangular hole (key hole) 72, a coil spring 73 (pushing member: a part of the coupling guide mechanism), and guide plates 74 (guide members: a part of the coupling guide mechanism).

The inner tube 71 is integrally rotatable about the driving shaft 701 and is externally fit on the driving shaft 701 so as to be movable in the shaft center direction. The driving shaft 701 is installed by penetrating through the back plate 27, so that it is able to oppose the shaft head 440 at the right end of the feeder shaft 441 concentrically. The triangular hole 72 is a hole made in the tip end face (left end face) of the inner tube 71 concentrically, into which the triangular key 62 is fit in a sliding contact state. The coil spring 73 is externally fit on the driving shaft 701, and interposed in a space between the inner tube 71 and the back plate 27 in a compressed state. The guide plates 74 are a pair of members in front and rear corresponding to a pair of the guided plate pieces 64 of the container-side joint member 60 and provided to protrude leftward from the back plate 27 while opposing the inner tube 71.

The driving shaft 701 has a flat D-cut surface 702 formed by applying cutting work (so-called D-cutting work) flatly so that a part of the peripheral surface thereof extends in the longitudinal direction. The driving shaft 701 is driven to rotate about the shaft center as a driving force of the driving motor 79 is transmitted directly or via a specific gear mechanism.

As is shown in the inset in FIG. 4A, the inner tube 71 is provided with an externally fitting hole 711 made in the right end face concentrically with the inner tube 71, into which the driving shaft 701 is inserted in a sliding contact state. A flat surface 712 (FIG. 4B) corresponding to the D-cut surface 702 of the driving shaft 701 is formed in a part of the inner peripheral surface of the external fitting hole 711. Hence, by driving the driving shaft 701 to rotate by the driving of the driving motor 79 while the driving shaft 701 is fit in the external fitting hole 711, the inner tube 71 starts to rotate integrally with the driving shaft 701 about the shaft center thereof.

A partition wall 713 is provided somewhere between the triangular hole 72 and the external fitting hole 711 in the inner tube 71. A stopper screw 714 penetrates through the partition wall 713 concentrically from the triangular hole 72 side in a sliding contact state with the partition wall 713. The tip end of the stopper screw 714 is screwed into a screw hole made in a threaded manner in the tip end surface of the driving shaft 701. This configuration prevents the driving shaft 701 from coming off from the external fitting hole 711 against a pushing force of the coil spring 73.

A clearance of a specific dimension is formed between the tip end surface of the driving shaft 701 and the partition wall 713 while the driving shaft 701 is in a state so as not to come off. The inner tube 71 is thus able to move forward and backward in the right-left direction by an amount comparable to the dimension of the clearance.

For a pair of the guide plates 74, the inner dimension of a space therebetween is set to be slightly wider than the outer dimension of a pair of the guided plate pieces 64 of the outer tube 61 to allow the container-side joint member 60 to be fit in a space between a pair of the guide plates 74. These guide plates 74 are provided to stand up from the partition plate 21*b*, and have a top-bottom dimension such that the top end thereof reaches the position directly below the closed tray main body 81 (FIG. 1A).

A guiding inclined portion 741 inclined to increase a spaced apart distance upward is formed on each top end portion of a pair of the guide plates 74. The container 40, when loaded into the loading space V from above, can be readily loaded into the loading space V while being positioned as the guided plate pieces 64 of the container-side joint member 60 are introduced into a space between the guide plates 74 by the guiding inclined portions 741.

The coupling guide mechanism in the claimed invention is a coupling guide structure 51 formed by including the coil spring 73 that pushes the inner tube 71 toward the container-side joint member 60 and the pressing pieces 63 having the inclined surfaces 631 and provided to the outer tube 61 as well as a pair of the guide plates 74 and a pair of the guided plate pieces 64.

In the toner container attaching and detaching structure 50 configured in this manner, the inner tube 71, while being pushed leftward by the coil spring 73 when the toner container 40 is not loaded in the loading space V, is set to a position at which it will be able to interfere with the bottom end portions of the inclined surfaces 631 that are formed on the pressing pieces 63 provided to the outer tube 61 having the tip ends to be fit in a space between a pair of the guide plates 74.

According to the toner container attaching and detaching structure 50 configured in this manner, when the toner container 40 is loaded into the loading space V from the maintenance opening 21*a* side (that is, loaded from sideway) while the maintenance door 26 is open, as is indicated by a solid arrow in FIG. 4A, it is possible to externally fit the outer tube 61 on the inner tube 71 by merely pushing the toner container 40 into the loading space V. The container-side joint member 60 and the printer-side joint member 70 are thus brought into a mutually coupled state.

By closing the maintenance door 26 in this state, the U-shaped piece 453 (FIG. 3B) of the locking operation member 45 provided to the maintenance door 26 externally fits on the locking piece 432 provided to the left surface plate 430 of the side surface lid 43 of the toner container 40. By subsequently rotating the operation dial 454 of the locking operation member 45 about the penetrating shaft 451 by 900 in a clockwise direction, the locking piece 432 enfolded by the U-shaped piece 453 rotates together about the protruding shaft 433 (FIG. 3C). The container 40 is thus locked in a loaded state in the printer main body 2.

On the contrary, as is indicated by an alternate long and short dash line in FIG. 4A, in a case where the toner container 40 is loaded in the loading space V from the top plate opening 25*a* side (that is, loaded in the longitudinal direction (radial direction) from above) while the sheet discharge tray 80 is open, the coupling guide structure 51 of this embodiment plays a crucial role.

Figure 5A:
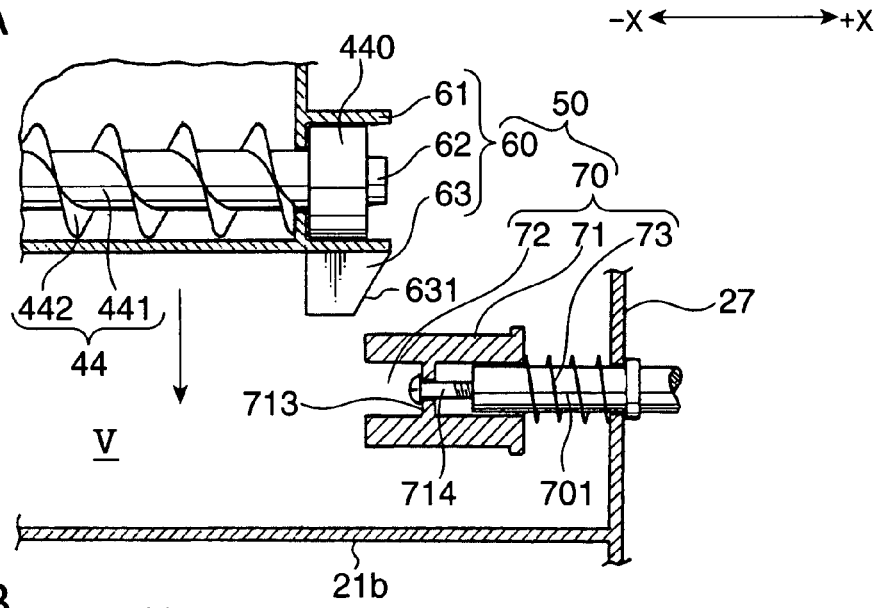
FIGS. 5A through 5C are explanatory views used to describe the function of the toner container attaching and detaching structure when the toner container is inserted longitudinally.
Figure 5B:
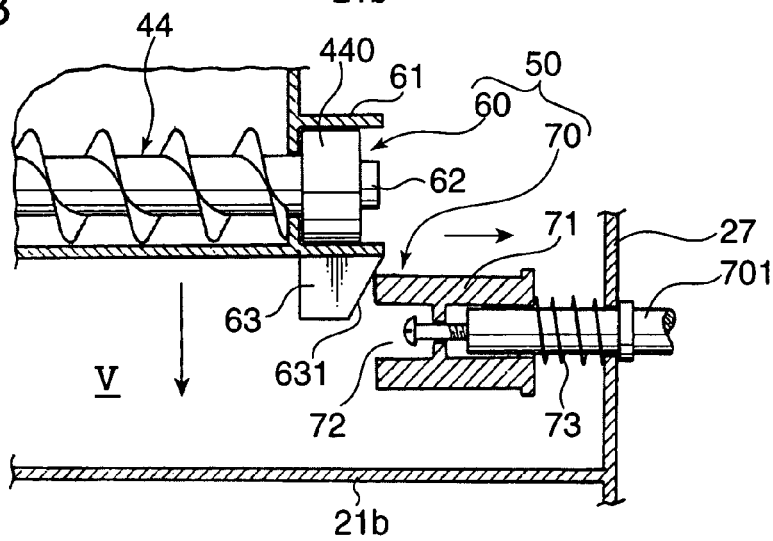
Figure 5C:
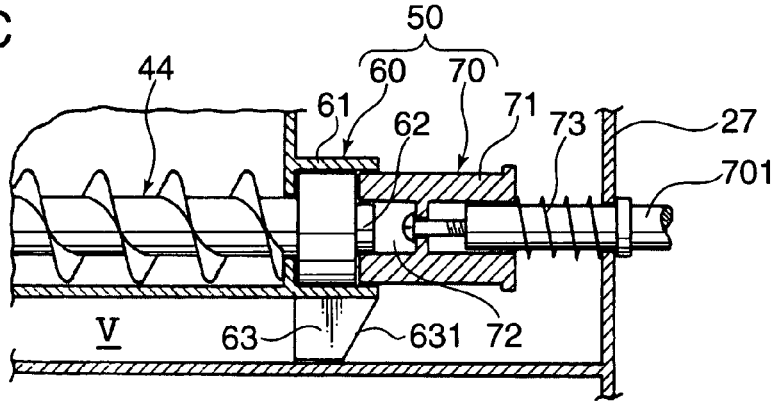

Hereinafter, the function of the toner container attaching and detaching structure 50 according to the first embodiment when the toner container 40 is inserted longitudinally into the loading space V in the printer main body 2 will be described with reference chiefly to FIGS. 5A through 5C and to FIG. 1A through FIG. 4B when the need arises. FIGS. 5A through 5C are explanatory views used to describe the function of the toner container attaching and detaching structure 50 when the toner container 40 is inserted longitudinally. FIG. 5A shows a state immediately before the container-side joint member 60 is coupled to the printer-side joint member 70. FIG. 5B shows a state where the container-side joint member 60 is being coupled to the printer-side joint member 70, and FIG. 5C shows a state where the container-side joint member 60 has been coupled to the printer-side joint member 70. The indication of direction using a capital X in FIGS. 5A through 5C is the same as in FIGS. 1A and 1B, that is, (−X: leftward, +X: rightward).

Initially, as is shown in FIG. 5A, in a state before the container-side joint member 60 is coupled to the printer-side joint member 70, the inner tube 71 of the printer-side joint member 70 is in a state where it protrudes leftward by a pushing force of the coil spring 73.

In this state, by further moving down the toner container 40 inserted into the loading space V in the printer main body 2 from above while being guided by a pair of the guide plates 74 (FIG. 4A), the inclined surfaces 631 of the pressing pieces 63 of the container-side joint member 60 press the inner tube 71 of the printer-side joint member 70 downward. Then, as is shown in FIG. 5B, the inner tube 71 moves rightward against a pushing force of the coil spring 73 by a component force of the resulting pressing force heading rightward.

When the toner container 40 is fully pushed into the loading space V, the inner tube 71 is in a state where the tube center thereof coincides with the shaft center of the feeder shaft 441 of the spiral feeder 44. The inner tube 71 thus fits in the outer tube 61 due to a pushing force of the coil spring 73. Then, as is shown in FIG. 5C, the triangular hole 72 of the inner tube 71 externally fits on the triangular key 62 formed on the tip end face of the shaft head 440 at the right end of the feeder shaft 441 internally fit in the outer tube 61. The container-side joint member 60 is thus coupled to the printer-side joint member 70 to be integrally rotatable.

Incidentally, when the toner container 40 is loaded into the loading space V in the printer main body 2 from above, the maintenance door 26 is closed as is shown in FIG. 1B. Hence, as the toner container 40 is pushed into the loading space V, the locking piece 432 (FIG. 3B) provided to the side surface lid 43 fits in the U-shaped piece 453 by itself. The locking piece 432, having fit in the U-shape piece 453, is then locked by the operation on the operation dial 454 in the same manner as in the case where the toner container 40 is inserted from sideway described above.

Subsequently, when the toner container 40 loaded in the loading space V is removed from the loading space V upward, the operation dial 454 (FIGS. 3B and 3C) is operated first to release the locking state of the U-shaped piece 453 on the locking piece 432, and the maintenance door 26 is then opened slightly. Accordingly, the side surface lid 43 of the toner container 40 is released from the state being pressed by the U-shaped piece 453 of the locking operation member 45. This allows the toner container 40 to move slightly leftward, which can in turn release the externally fit state of the outer tube 61 on the inner tube 71 (that is, the coupling state of the container-side joint member 60 to the printer-side joint member 70). Once the coupling state of the container-side joint member 60 to the printer-side joint member 70 is released, the toner container 40 can be pulled out upward from the loading space V.

Figure 6B:
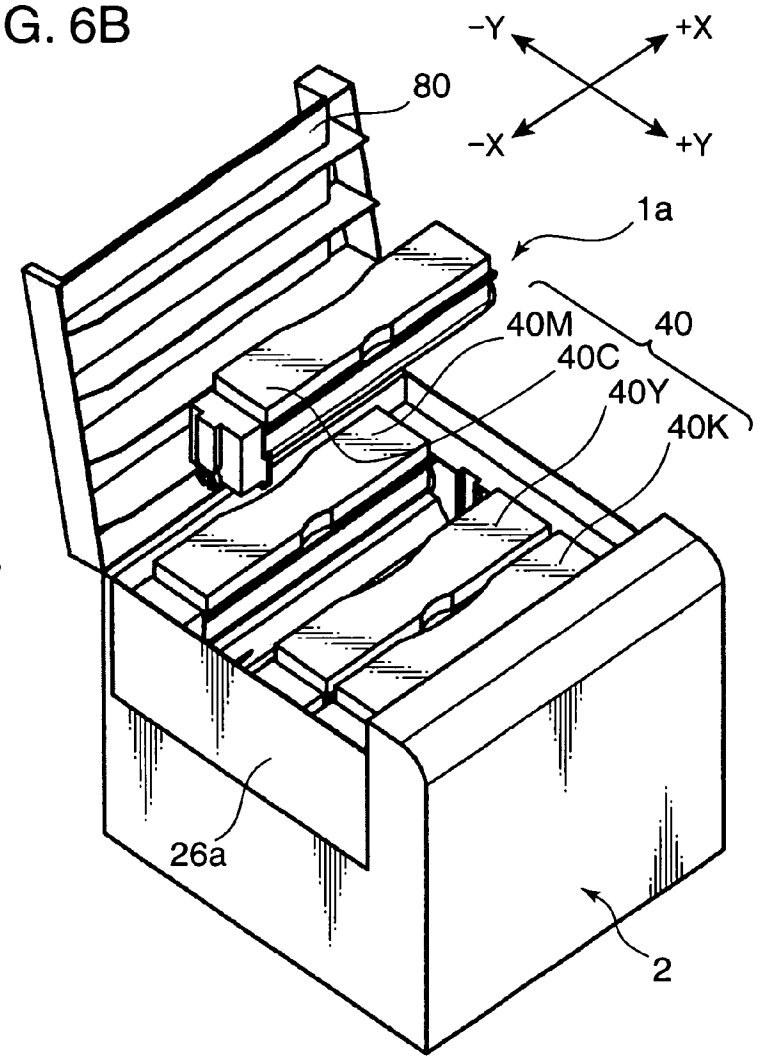
FIGS. 6A and 6B are perspective views showing a printer according to a second embodiment of the invention, FIG. 6A showing a state where the toner container is being loaded into the printer from the left surface side of the printer and FIG. 6B showing a state where the toner container is being loaded into the printer from the top surface side of the printer.
Figure 6A:
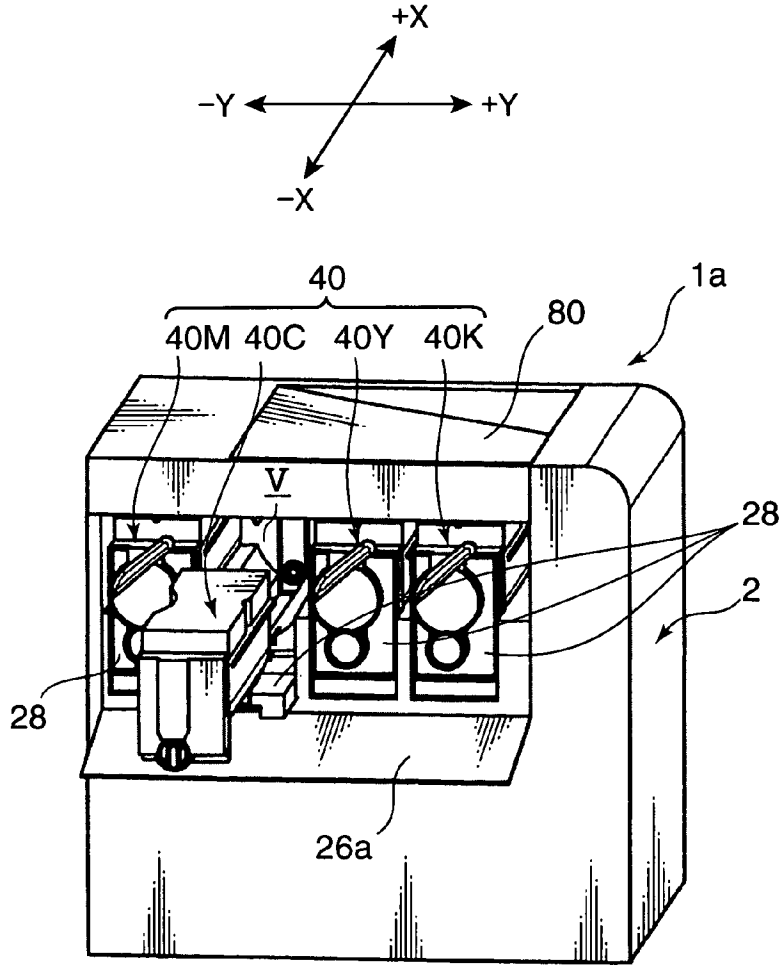

FIGS. 6A and 6B are perspective views of a printer according to a second embodiment of the invention. FIG. 6A shows a state where the toner container is being loaded into the printer from the left surface side of the printer, and FIG. 6B shows a state where the toner container is being loaded into the printer from the top surface side of the printer. The indication of direction using capitals X and Y in FIGS. 6A and 6B is the same as in FIGS. 1A and 1B, that is, (X is the right-left direction (−X: leftward, +X: rightward) and Y is the front-rear direction (−Y: frontward, +Y: rearward)).

A printer 1*a* of the second embodiment is different from the printer 1 of the first embodiment in that the toner container 40M for magenta, the toner container 40C for cyan, the toner container 40Y for yellow, and the toner container 40K for black are loaded attachably and detachably into the loading spaces V in the printer main body 2 sequentially from the one at the forefront position toward the rear. By loading the toner containers 40 in the printer main body 2 in the order specified above, the respective devices installed inside the printer main body 2, such as the photoconductive drums 4M, 4C, 4Y, and 4K and the developing devices 11M, 11C, 11Y, and 11K, are disposed in a mirror symmetric state in the front-rear direction with the counterparts of the first embodiment shown in FIG. 2.

According to the installment as above, the sheet discharge tray 80 is able to change the posture between the closing posture (FIG. 6A) and the opening posture (FIG. 6B) by setting the rotating center on the front edge portion of the top surface of the printer main body 2. A sheet P done with the fixing processing is discharged toward the sheet discharge tray 80 from the upper rear of the printer main body 2. Also, a maintenance door 26*a* for exclusive use for the toner containers 40 is provided, and although it is not shown in the drawing, another door for exclusive use is provided for the image forming unit 12 (FIG. 1A).

Further, the printer 1*a* is provided with separate doors 28 for the respective toner containers 40M, 40C, 40Y, and 40K immediately inside the maintenance door 26*a* in the printer main body 2. When the respective toner containers 40M, 40C, 40Y, and 40K are inserted in and removed from the loading spaces V from sideway, both the maintenance door 26*a* and the separate doors 28 are opened. Meanwhile, after the respective toner containers 40M, 40C, 40Y, and 40K are loaded in the loading spaces V, both the separate doors 28 and the maintenance door 26*a* are closed.

In the printer 1*a*, a printer-side joint member 70*a* as a component forming a toner container attaching and detaching structure 50*a* is different from the printer-side joint member 70 (FIGS. 4A and 4B) of the first embodiment. The printer-side joint member 70*a* will be described below with reference to FIGS. 8A and 8B.

Figure 7A:
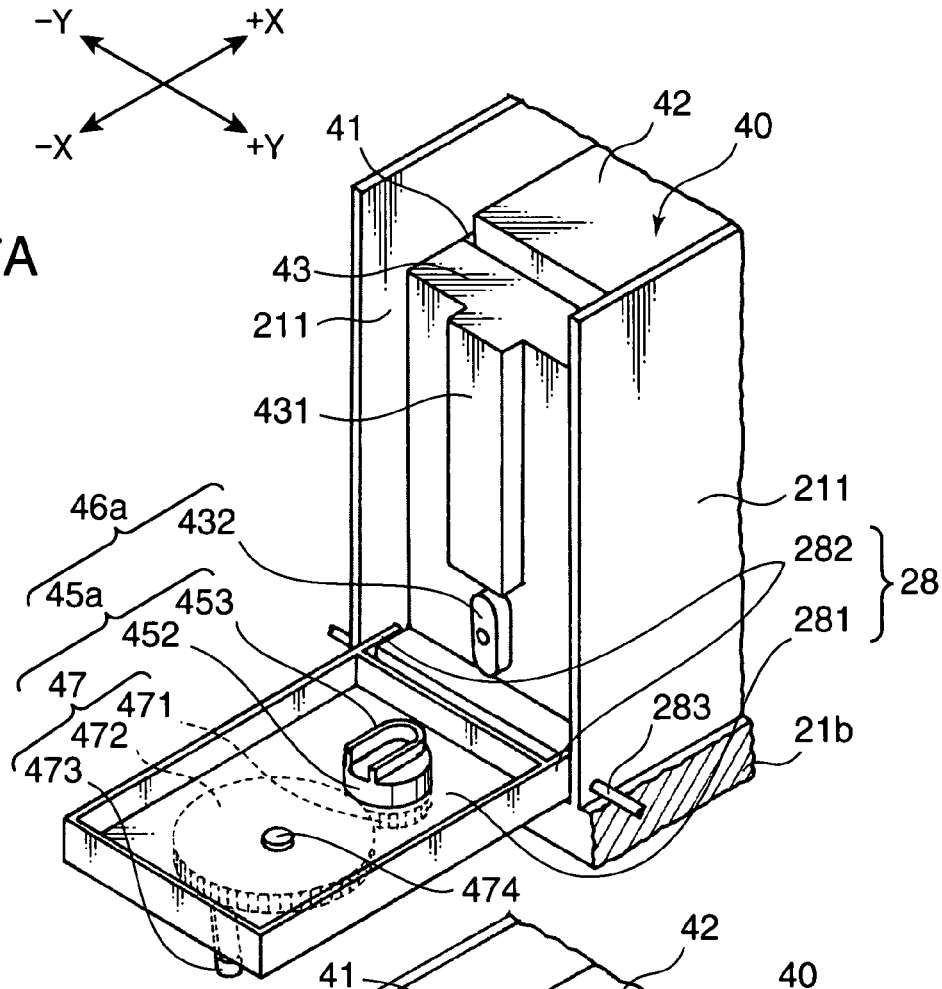
FIGS. 7A and 7B are perspective views showing one embodiment of a separate door, FIG. 7A showing a state where the separate door is open and FIG. 7B showing a state where the separate door is closed.
Figure 7B:
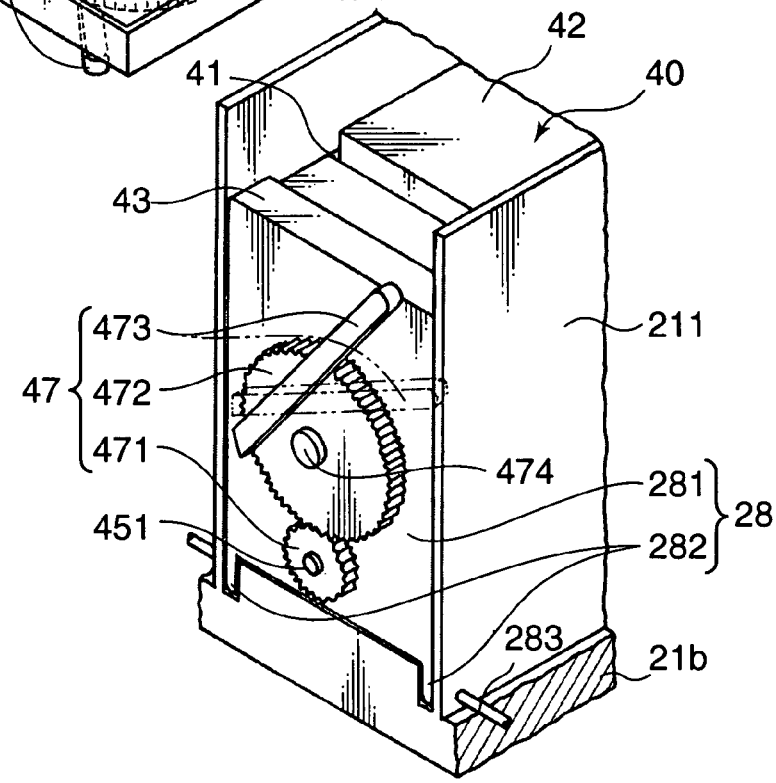

FIGS. 7A and 7B are perspective views showing one embodiment of the separate doors 28. FIG. 7A shows a state where the separate door 28 is open, and FIG. 7B is a state where the separate door 28 is closed. The indication of direction using capitals X and Y in FIGS. 7A and 7B is the same as in FIGS. 1A and 1B, that is, (X is the right-left direction (−X: leftward, +X: rightward) and Y is the front-rear direction (−Y: frontward, +Y: rearward)).

The separate door 28 includes a door main body 281 having a front-rear width dimension slightly shorter than the inner dimension of every pair of the dividing plates 211 and a top-bottom dimension almost equal to the top-bottom dimension of the dividing plates 211, and a pair of brackets 282 in front and rear provided to protrude outward from the base end portion (the bottom end portion in the state shown in FIG. 7B) of the door main body 281.

A pair of the brackets 282 is axially supported to be rotatable about a supporting shaft 283 installed across a space between every pair of the dividing plates 211 in close proximity to the bottommost portion of the dividing plates 211. This configuration enables the separate door 28 to change the posture between the opening posture (FIG. 7A) in which it protrudes leftward from the bottom portion of the loading space V and the closing posture (FIG. 7B) in which it closes the opening in the left end surface of the loading space V.

Stopping pieces (not shown in the drawing) made of plate springs are fixedly screwed into the front and rear edge portions of the door main body 281 of the separate door 28. The separate door 28, while the posture thereof is set to the closing posture, maintains the closing posture as these stopping pieces undergo elastic deformation until they are stopped by being pressed against the dividing plates 211.

The separate door 28 is provided with a locking structure 46*a* that locks the toner container 40 in the loaded state in the loading space V. The locking structure 46*a* includes a locking piece 432 same as the counterpart of the first embodiment and attached to the left surface plate 430 of the side surface lid 43, and a locking operation member 45*a* that spaces apart from and comes closer to the locking piece 432 in response to the opening and closing of the separate door 28.

The locking operation member 45*a* includes a disc plate 452 same as the counterpart of the first embodiment and attached to the back surface of the door main body 281 via a penetrating shaft 451 penetrating through the door main body 281, a U-shaped piece 453 same as the counterpart of the first embodiment and fixed to the disc plate 452, and an operation mechanism 47 that operates the U-shaped piece 453 via the disc plate 452. The disc plate 452 is set to a position at which the U-shaped piece 453 externally fits on the locking piece 432 while the posture of the separate door 28 is set to the closing posture (FIG. 7B).

The operation mechanism 47 includes a small diameter gear 471 concentrically and externally fit on the penetrating shaft 451 to be integrally rotatable on the surface side of the door main body 281, a large diameter gear 472 attached to the door main body 281 while being meshed with the small diameter gear 471 at the position directly above the small diameter gear 471, and an operation lever 473 fixed to the large diameter gear 472. The larger diameter gear 472 is axially supported to be rotatable about a gear shaft 474 provided to protrude outward from substantially the center of the door main body 281.

The operation lever 473 is to rotate the large diameter gear 472 about the gear shaft 474. The operation lever 473 is set in a direction so as to extend to point upward toward the rear as is indicated by a solid line in FIG. 7B while the U-shaped piece 453 locks the locking piece 432 (FIG. 3C). Hence, by operating the rear end portion of the operation lever 473 in this state downward as is indicated by a chain double-dashed line in FIG. 7B, the top surface lid 42 rotates about the gear shaft 474 in a clockwise direction. This rotation is transmitted to rotate the small diameter gear 471 about the penetrating shaft 451 in a counterclockwise direction. The U-shaped piece 453 thus changes the posture to an upright standing posture, which releases the locking piece 432 from the locked state.

Figure 8A:
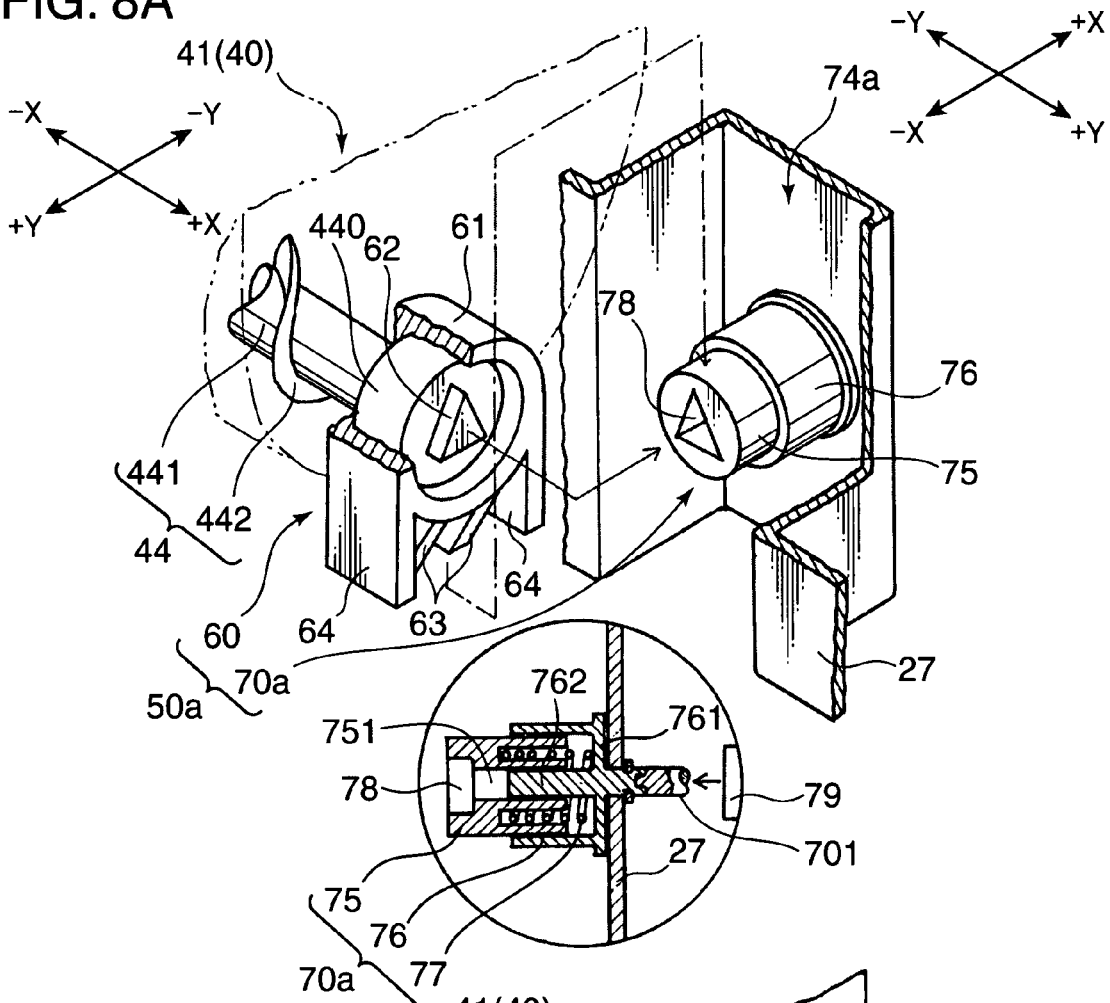
FIGS. 8A and 8B are perspective views showing a printer-side joint member adapted to the printer of the second embodiment, FIG. 8A showing a state where the container-side joint member and the printer-side joint member are not coupled to each other and FIG. 8B showing a state where the both are coupled to each other.
Figure 8B:
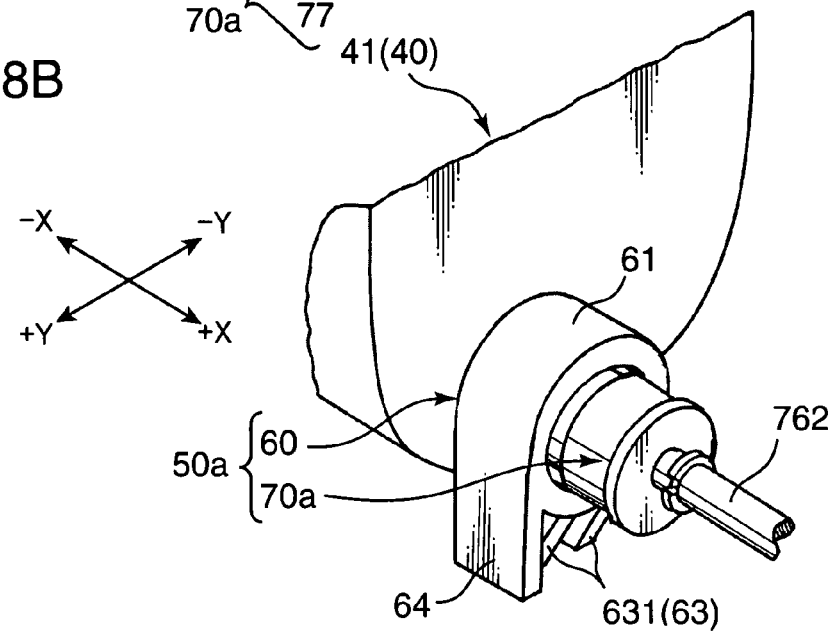

FIGS. 8A and 8B are perspective views showing the printer-side joint member 70*a* adapted to the printer la of the second embodiment. FIG. 8A shows a state where the container-side joint member 60 and the printer-side joint member (apparatus-main-body-side joint member) 70*a* are not coupled to each other, and FIG. 8B shows a state where the container-side joint member 60 and the printer-side joint member 70*a* are coupled to each other. The inset in FIG. 8A is a cross section of the printer-side joint member 70*a*. The indication of direction using capitals X and Y in FIGS. 8A and 8B is the same as in FIGS. 1A and 1B, that is, (X is the right-left direction (−X: leftward, +X: rightward) and Y is the front-rear direction (−Y: frontward, +Y: rearward)).

Because the container-side joint member 60 is the same as the counterpart of the first embodiment, the printer-side joint member 70*a* alone will be described hereinafter. The printer-joint member 70*a* includes an inner tube 75 disposed oppositely to the outer tube 61 of the container-side joint member 60, a base tube 76 with the bottom into which the inner tube 75 is internally fit so as to be movable in the right-left direction, and a coil spring 77 interposed between the base tube 76 and the inner tube 75 to push the inner tube 75 in a direction to space apart from the base tube 76.

The inner tube 75 has the major diameter dimension set to be slightly smaller than the minor diameter dimension of the outer tube 61, and can be therefore internally fit in the outer tube 61. The inner tube 75 is provided with an externally fitting hole 751 made at the tube center position to extend in the right-left direction. The base tube 76 is provided with a center shaft 762 provided concentrically and integrally with a bottom disc plate 761 to protrude from the center position thereof in a right-left direction.

A portion of the center shaft 762 on the left from the bottom disc plate 761 is fit in the externally fitting hole 751 in a sliding contact state to be integrally rotatable. On the contrary, a portion of the center shaft 762 protruding rightward from the bottom disc plate 761 penetrates through the back plate 27 and is coupled concentrically to the driving shaft 701 to be integrally rotatable. The driving of the driving motor 79 is thus transmitted to the base tube 76 via the driving shaft 701, and the inner tube 75 rotates in association with the rotations of the base tube 76 by the driving thus transmitted.

A triangular hole 78 that is externally fit on the triangular key 62, which is provided to protrude rightward from the right end face of the shaft head 440, in a state so as not to turn is provided on the left end face of the inner tube 75. As the triangular hole 78 is externally fit on the triangular key 62, the driving rotation of the printer-side joint member 70*a* is transmitted to the spiral feeder 44.

Figure 9A:
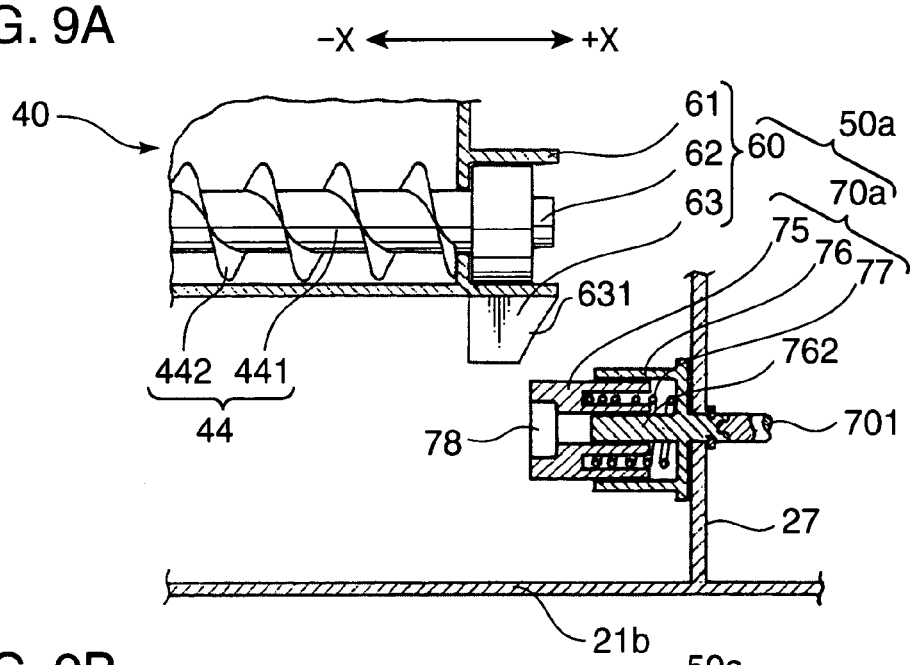
FIGS. 9A through 9C are explanatory views used to describe the function of the toner container attaching and detaching structure when the toner container is inserted longitudinally.
Figure 9B:
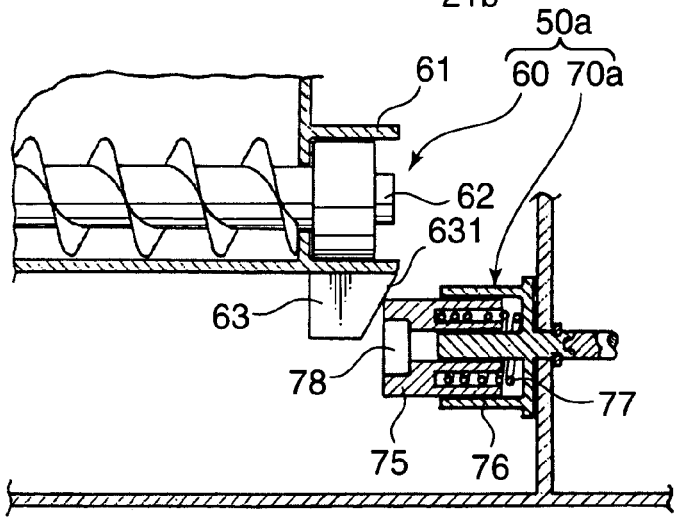
Figure 9C:
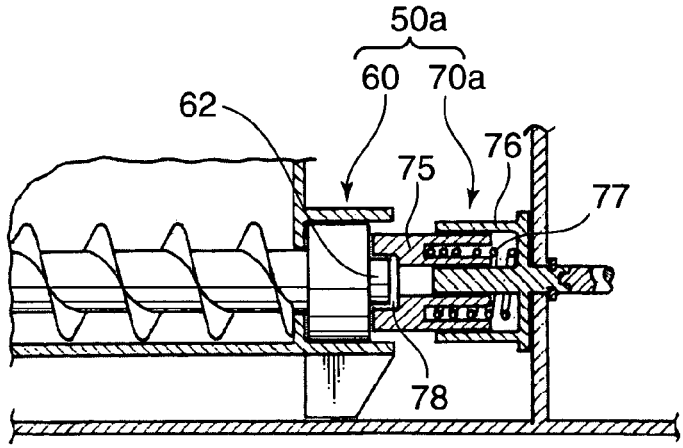

In the second embodiment, the back plate 27 of the printer main body 2 is provided with a guide groove 74*a* extending in the top-bottom direction instead of a pair of the guiding plates 74 of the first embodiment. The container-side joint member 60 is guided by the guide groove 74*a*. Also, the printer-side joint member 70*a* is provided at the groove bottom of the guide groove 74*a*.

the function of the toner container attaching and detaching structure 50*a* of the second embodiment when the toner container 40 is inserted longitudinally into the loading space V in the printer main body 2 will be described with reference chiefly to FIGS. 9A through 9C and to FIGS. 6A through 8B when the need arises. FIGS. 9A through 9C are explanatory views used to describe the function of the toner container attaching and detaching structure 50*a* when the toner container 40 is inserted longitudinally. FIG. 9A shows a state immediately before the container-side joint member 60 is coupled to the printer-side joint member 70*a*, FIG. 9B shows a state where the container-side joint member 60 is being coupled to the printer-side joint member 70*a*, and FIG. 9C shows a state where the container-side joint member 60 has been coupled to the printer-joint member 70*a*. The indication of direction using a capital X in FIGS. 9A through 9C is the same as in FIGS. 1A and 1B, that is, (−X: leftward, +X: rightward).

Initially, as is shown in FIG. 9A, in a state before the container-side joint member 60 is coupled to the printer-side joint member 70*a*, the inner tube 71 of the printer-side joint member 70*a* is in a state where it protrudes leftward by a pushing force of the coil spring 77.

In this state, by further moving down the toner container 40 inserted into the loading space V in the printer main body 2 from above while being guided by the guide groove 74*a* (FIG. 8A), the inclined surfaces 631 of the pressing pieces 63 of the container-side joint member 60 press the inner tube 75 of the printer-side joint member 70*a* downward. The inner tube 75 then moves rightward against a pushing force of the coil spring 77 as is shown in FIG. 9B by a component force of the resulting pressing force heading rightward.

By pushing the toner container 40 fully into the loading space V, the inner tube 75 is brought in a state where the tube center coincides with the shaft center of the feeder shaft 441 of the spiral feeder 44. The inner tube 75 is thus fit in the outer tube 61 by a pushing force of the coil spring 77, and as is shown in FIG. 9C, the triangular hole 78 of the inner tube 75 is externally fit on the triangular key 62 formed on the tip end face of the shaft head 440. The container-side joint member 60 is thus coupled to the printer-side joint member 70*a* to be integrally rotatable.

Incidentally, when the toner container 40 is loaded into the loading space V in the printer main body 2 from above, because the maintenance door 26*a* is closed as is shown in FIG. 6B, by pushing the toner container 40 further into the loading space V, the locking piece 432 (FIG. 7A) provided to the side surface lid 43 fits into the U-shaped piece 453 by itself. The operation dial 454 is operated after the locking piece 432 fits in the U-shaped piece 453 so as to be locked.

When the toner container 40 loaded in the loading space V is removed from the loading space V upward, the operation lever 473 indicated by a chain double-dash line in FIG. 7B is rotated about the gear shaft 474 in a counterclockwise direction. Accordingly, the locking piece 432 is released from the locking by the U-shape piece 453 of the locking operation member 45. In this state, by slightly opening the maintenance door 26*a* to let the toner container 40 move slightly leftward, the U-shaped piece 453 comes off from the locking piece 432, which allows the toner container 40 to be pulled out upward from the loading space V.

As has been described in detail, the toner container attaching and detaching structure 50/50*a* of the embodiments above is provided across the toner containers 40 installed attachably to and detachably from the printer main body 2 to replenish the developers to the developing devices 11M, 11C, 11Y, and 11K installed inside the printer main body 2 of the printer 1/1*a*. The toner container attaching and detaching structure 50/50*a* includes the container-side joint member 60, the printer-side joint member 70/70*a*, and the coupling guide structure 51 that couples the container-side and printer-side joint members 60 and 70/70*a*. The driving force of the driving source equipped to the printer main body 2 is transmitted to the container-side joint member 60 via the printer-side joint member 70/70*a* while the container-side and the printer-side joint members 60 and 70/70*a* are coupled to each other by the coupling guide structure 51. When the toner container 40 is attached to and detached from the printer main body 2 in either the lateral direction (axial direction) or the longitudinal direction (radial direction), the coupling guide structure 51 is able to couple the container-side joint member 60 and the printer-side joint member 70/70*a* to each other.

By configuring the toner container attaching and detaching structure 50/50*a* in this manner, regardless of whether the printer 1/1*a* is of the type to and from which the toner containers 40 are attached and detached in a longitudinal direction or in a lateral direction, it is possible to load the toner containers 40 in the printer main body 2 of the printer 1/1*a* according to the attaching and detaching method of the toner containers 40 adopted by the printer 1/1*a*. According to such loading, the container-side joint member 60 is coupled to the printer-side joint member 70/70*a* via the coupling guide structure 51. The driving force of the printer main body 2 side is thus transmitted to the container-side joint member 60 via the printer-side joint member 70/70*a*. Consequently, because the stirring member installed inside each toner container 40 is driven via the container-side joint member 60, the developer inside the toner container 40 is stirred by this driving.

As has been described, whether the toner containers 40 are loaded in the printer main body 2 of the printer 1/1*a* longitudinally or laterally depending on the inserting and removing method of the toner containers 40 adopted by the printer main body 2, the container-side joint member 60 is coupled to the printer-side joint member 70/70*a* appropriately by the function of the coupling guide structure 51. Hence, the toner containers 40 can be used commonly for the printers 1 and 1*a* adopting different methods.

It is thus possible to eliminate the need to manufacture the toner containers 40 of specifications that differ for each inserting and removing method of the containers 40 adopted by the printers 1 and 1*a* as was in the conventional case. Because it is sufficient to provide one manufacturing line in the manufacturing facility of the toner containers 40, the cost of the manufacturing facilities of the toner containers 40 can be reduced proportionately. In addition, because it is not necessary to make adjustment to meet the movement of demand for two types of the image forming apparatus adopting different inserting and removing methods, not only can the cost of manufacturing be reduced proportionately owing to the mass production effect, but also the need to manage two kinds of product items can be eliminated, which can in turn reduce the cost of management.

In the toner container attaching and detaching structure 50/50*a*, the container-side joint member 60 includes the triangular key 62 provided to protrude concentrically in the shaft center direction from the end face of the shaft head 440 of the spiral feeder 44 installed inside the toner container 40, and the outer tube 61 that is integral with the container main body 41 of the toner container 40 and concentrically and externally fit on the shaft head 440 so as to be rotatable relatively to each other. The printer-side joint member 70/70*a* includes the triangular hole 72 into which the triangular key 62/78 that is formed concentrically on the end face of the specific driving shaft 701 provided to the printer main body 2 to be integrally rotatable is concentrically and internally fit to be integrally rotatable, and the inner tube 71/75 on which the outer tube 61 is concentrically and externally fit so as to be rotatable relatively to each other. The coupling guide structure 51 includes the coil spring 73/77 that pushes the inner tube 71/75 toward the container-side joint member 60 along the driving shaft 701, and the pressing pieces 63 provided to protrude outward in the radial direction from the bottom peripheral surface of the outer tube 61 and having the inclined surfaces 631 inclined to point downward from the tip end edge toward the base end of the outer tube 61 at the bottom surfaces thereof.

According to the configuration as above, in a case where the printer 1/1*a* adopts the longitudinal inserting and removing method for inserting and removing the toner containers 40 in the longitudinal direction, by inserting the toner container 40 into the printer main body 2 downward from above, the inclined surfaces 631 of the pressing pieces 63 provided to the outer tube 61 are pressed against the inner tube 71/75.

By continuing the push-in operation of the toner container 40 into the printer main body 2 while the inclined surfaces 631 of the pressing pieces 63 are kept pressed against the inner tube 71/75, the inner tube 71/75 undergoes a component force of the pressing force heading downward of the toner container 40 via the inclined surfaces 631. The inner tube 71/75 thus moves temporarily in a direction to space apart from the outer tube 61 against a pushing force of the coil spring 73/77.

Subsequently, the inner tube 71/75 relatively passes by the top end portions of the inclined surfaces 631 of the pressing pieces 63, and when it becomes concentric with the outer tube 61, it is fit into the outer tube 61 by a pushing force of the coil spring 73/77. The triangular hole 72 of the inner tube 71/75 thus externally fits on the triangular key 62/78 of the outer tube 61. This external fitting allows the container-side joint member 60 and the printer-side joint member 70/70*a* to be coupled to each other. The driving rotation of the driving shaft 701 is thus transmitted to the feeder shaft 441 of the toner container 40 via the printer-side joint member 70/70*a* and the container-side joint member 60. Stirring is therefore applied to the developer inside the toner container 40 as the spiral feeder 44 is activated by the rotation of the feeder shaft 441.

When the toner container 40 is detached from the printer main body 2, the toner container 40 is pulled out in a direction along which the inner tube 71/75 is spaced apart from the outer tube 61 against the pushing force of the coil spring 73/77, or alternatively, in a direction along which the outer tube 61 is spaced apart from the inner tube 71/75. Incidentally, the embodiments above adopt a method of pulling the toner container 40 in a direction in which the outer tube 61 is spaced apart from the inner tube 71/75 by pulling the toner container 40 toward the maintenance door 26. Accordingly, the triangular hole 72 of the inner tube 71/75 removes from the triangular key 62/78 of the outer tube 61, which brings the printer-side joint member 70/70*a* and the container-side joint member 60 into an edge cutting state with each other. It is thus possible to pull out the toner container 40 upward from the printer main body 2.

On the contrary, in a case where the printer 1/1*a* adopts the lateral inserting and removing method for inserting and removing the container 40 in the lateral direction, by pushing the toner container 40 into the printer main body 2 by providing the printer-side joint member 70/70*a* oppositely to the container-side joint member 60 at the innermost portion of the printer main body 2 in the push-in direction of the toner container 40, the outer tube 61 of the toner container 40 is externally fit on the inner tube 71/75 of the printer main body 2 without particularly being affected by the function of the pressing pieces 63 or the coil spring 73/77. The triangular key 62/78 thus fits in the triangular hole 72 and the respective joint members are coupled to each other.

By configuring the coupling guide structure 51 as above, the toner container 40 can be loaded into the printer main body 2 either longitudinally or laterally depending on the type of the printer 1/1*a*, and moreover, the coupling guide structure 51 can be simpler at the same time. It is thus possible to reduce the cost of manufacturing the toner containers 40 and the printer main body 2.

Further, a pair of the guided plate pieces 64 provided in parallel with each other to protrude in the protruding direction of the pressing pieces 63 with the pressing pieces 63 in between is provided on the peripheral surface of the outer tube 61, and a pair of the guide plates 74 to guide the movement of a pair of the guided plate pieces 64 when attaching and detaching the toner container 40 is provided to the printer main body 2. Hence, when the toner container 40 is loaded into the printer main body 2 of the printer 1/1*a* in the longitudinal direction, a pair of the guided plate pieces 64 of the toner container 40 is guided while the position thereof is determined by fitting into a space between a pair of the guiding plates 74 of the printer main body 2. The container-side joint member 60 is thus introduced toward the printer-side joint member 70/70*a* in a reliable manner, and the operation performance of loading the toner container 40 into the printer main body 2 can be satisfactory.

In addition, the locking structure 46/46*a* formed of the locking operation member 45/45*a* and the locking piece 432 to lock the toner container 40 in the loaded state in the printer main body 2 is provided. The toner container 40 loaded in the printer main body 2 is thus locked by the locking structure 46/46*a*, which ensures the loaded state of the toner container 40 in the printer main body 2.

It should be appreciated that the invention is not limited to the embodiments described above, and the invention also includes the following contents.

(1) The embodiments above have been described using the printers 1 and 1*a* as examples of the image forming apparatus. However, the image forming apparatus can be a copying machine or a facsimile machine.

(2) The embodiments above have been described using the printers 1 and 1*a* configured in such a manner that the toner container 40 can be inserted and removed either longitudinally or laterally by way of example. The invention, however, is also applicable to an image forming apparatus in and from which the toner container 40 can be inserted and removed only in one direction.

(3) The embodiments above have been described using the printers 1 and 1*a* for color printing by way of example. However, a printer for monochrome printing can be used as well.

(4) The embodiments above described an example where the triangular key 62/78 formed on the end face of the shaft head 440 at the right end of the feeder shaft 441 is adopted as the coupling key of the container-side joint member 60, and the triangular hole 72 is adopted as the key hole provided concavely on the end face of the inner tube 71 of the printer-side joint member 70 and corresponding to the coupling key. The invention, however, is not limited to this configuration, and any configuration is applicable as long as the spiral feeder 44 and the driving shaft 701 are coupled to each other to be integrally rotatable.

(5) The embodiments above described a case where the radial direction of the feeder shaft (rotating shaft) 441 is defined as the longitudinal direction and the axial direction of the feeder shaft 441 is defined as the lateral direction as an example of the method of inserting and removing the toner container 40 into and from the printer main body 2. However, besides the foregoing, the toner container 40 may be loaded into the printer main body 2 at a slant from above the printer main body 2 in an inclined state. In this case, the configuration falls on a range to load the toner container 40 in the radial direction. Alternatively, the toner container 40 may be loaded in the printer 2 at a slant from the front surface or the side surface of the printer main body 2 in an inclined state. In this case, the configuration falls on a range to load the toner container 40 in the axial direction.

The specific embodiments described above include the inventions having the following configurations.

An image forming apparatus according to an aspect of the invention includes: an apparatus main body; a developing device installed inside the apparatus main body; a toner container provided attachably to and detachably from the apparatus main body to replenish the developing device with a developer; a rotating shaft installed in the toner container to be rotatable; a first joint member provided on one of end portions of the toner container and coupled to the rotating shaft; a second joint member provided to the apparatus main body oppositely to the first joint member; a coupling guide mechanism that couples the first and second joint members to each other; and a driving source equipped to the apparatus main body to generate a specific driving force, wherein the driving force of the driving source is transmitted to the first joint member via the second joint member while the first and second joint members are coupled to each other by the coupling guide mechanism, and the coupling guide mechanism couples the first joint member and the second joint member to each other whether the toner container is loaded into the apparatus main body in an axial direction or in a radial direction of the rotating shaft.

According to the configuration as above, regardless of whether the image forming apparatus is of a type in and from which the toner container is attached and detached in the radial direction or a type in and from which the toner container is attached or detached in the axial direction, it is possible to load the toner container into the apparatus main body of the image forming apparatus either in the axial direction or the radial direction according to the toner container attaching and detaching method adopted by the image forming apparatus. Owing to this loading, the first joint member is coupled to the second joint member via the coupling guide mechanism and a driving force on the apparatus main body side is transmitted to the first joint member via the second joint member. The rotating shaft installed in the toner container is thus driven via the first joint member. Accordingly, the toner containers can be used in common for each image forming apparatus adopting a different inserting and removing method.

Hence, it is possible to eliminate the need to manufacture the toner containers of different specifications according to the inserting and removing methods of the toner container adopted by the respective image forming apparatus as was in the conventional case. Accordingly, because it is sufficient to provide one manufacturing line in the manufacturing facility of the toner containers, the cost of manufacturing facilities of the toner containers can be reduced proportionately. In addition, because it is not necessary to make adjustment to meet the movement of demand for two types of the image forming apparatus adopting different inserting and removing methods, the cost of manufacturing can be reduced proportionately owing to the mass production effect. At the same time, because there is no need to manage two types of product items, the management cost can be reduced as a consequence.

In the configuration described above, it is preferable that the first joint member includes a coupling key provided to protrude outward in the axial direction from an end face of the rotating shaft, and an outer tube formed on a housing of the toner container, into which an end portion of the rotating shaft is internally fit so as to be rotatable relatively to each other, and that the second joint member includes an inner tube coupled concentrically to a driving shaft of the driving source to be integrally rotatable, on which the outer tube is concentrically and externally fit so as to be rotatable relatively to each other, and a key hole provided concavely to the inner tube in a surface opposing the end face of the rotating shaft, into which the coupling key is fit to be integrally rotatable.

Also, it is preferable that the coupling guide mechanism includes a pushing member that pushes the inner tube toward the first joint member along the driving shaft, and a pressing piece provided to protrude outward in the radial direction from a peripheral surface of the outer tube and having an inclined surface that inclines from a tip end edge toward a base end of the outer tube.

In particular, it is preferable that: the first joint member includes a coupling key provided to protrude outward in the axial direction from an end face of the rotating shaft, and an outer tube formed on a housing of the toner container, on which an end portion of the rotating shaft is internally fit so as to be rotatable relatively to each other, the coupling key being accommodated in an internal space of the outer tube; the second joint member includes an inner tube coupled concentrically to a driving shaft of the driving source to be integrally rotatable, on which the outer tube is concentrically and externally fit so as to be rotatable relatively to each other, and a key hole provided concavely to the inner tube in a surface opposing the end face of the rotating shaft, into which the coupling key is fit to be integrally rotatable; the coupling guide mechanism includes a pushing member that pushes the inner tube toward the first joint member along the driving shaft, and a pressing piece provided to protrude outward in the radial direction from a peripheral surface of the outer tube and having an inclined surface that inclines from a tip end edge toward a base end of the outer tube; and when the first joint member and the second joint member are coupled to each other in a case where the toner container is loaded into the apparatus main body from the radial direction of the rotating shaft, the inner tube is moved in a direction opposite to a pushing direction by the pushing member due to interference with the inclined surface, and fits in the outer tube after having passed by the inclined surface.

According to these configurations, the toner container can be loaded into the apparatus main body either longitudinally or laterally depending on the toner container inserting and removing method adopted by the image forming apparatus, and moreover, the coupling guide mechanism can be simpler at the same time. It is thus possible to make a contribution to a reduction of the cost of manufacturing the toner containers and the apparatus main body.

In the configurations described as above, it is preferable that the coupling guide mechanism includes a pair of guided plate pieces provided in parallel with each other on a peripheral surface of the outer tube to extend downward in a tangential direction to the peripheral surface, and a pair of guide members provided to the apparatus main body to guide a movement of the pair of guided plate pieces when the toner container is attached and detached in the radial direction of the rotating shaft.

According to this configuration, when the toner container is loaded longitudinally into the apparatus main body of the image forming apparatus, a pair of the guided pieces of the toner container fits in a space between a pair of the guide members of the apparatus main body, and is thereby guided while being positioned in the width direction of the toner container. The first joint member is thus introduced toward the second joint member in a reliable manner. Accordingly, satisfactory operation performance can be achieved with the loading operation of the toner container into the apparatus main body.

In the configurations as described above, it is preferable to further include a locking structure provided to lock the toner container in a loaded state in the apparatus main body. According to this configuration, because the toner container loaded in the apparatus main body is locked by the locking structure, the loaded state is ensured.

In the configurations described as above, it is a preferable embodiment to configure in such a manner that the rotating shaft is a rotating shaft of a stirring member that stirs the developer.

This application is based on patent application No. 2006-217812 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an apparatus main body;

a developing device installed inside the apparatus main body;

a toner container provided attachably to and detachably from the apparatus main body to replenish the developing device with a developer;

a rotating shaft installed in the toner container to be rotatable;

a first joint member provided on one of end portions of the toner container and coupled to the rotating shaft;

a second joint member provided to the apparatus main body oppositely to the first joint member;

a coupling guide mechanism that couples the first and second joint members to each other; and a driving source equipped to the apparatus main body to generate a specific driving force, wherein:

the first joint member includes a coupling key provided to protrude outward in the axial direction from an end face of the rotating shaft and an outer tube formed on a housing of the toner container, into which an end portion of the rotating shaft is internally fit so as to be rotatable relatively to each other;

the second joint member includes an inner tube coupled concentrically to a driving shaft of the driving source to be integrally rotatable, on which the outer tube is concentrically and externally fit so as to be rotatable relatively to each other and a key hole provided concavely to the inner tube in a surface opposing the end face of the rotating shaft, into which the coupling key is fit to be integrally rotatable;

the driving force of the driving source is transmitted to the first joint member via the second joint member while the first and second joint members are coupled to each other by the coupling guide mechanism; and the coupling guide mechanism couples the first joint member and the second joint member to each other whether the toner container is loaded into the apparatus main body in an axial direction or in a radial direction of the rotating shaft.

2. The image forming apparatus according to claim 1, wherein the coupling guide mechanism includes:

a pushing member that pushes the inner tube toward the first joint member along the driving shaft; and a pressing piece provided to protrude outward in the radial direction from a peripheral surface of the outer tube and having an inclined surface that inclines from a tip end edge toward a base end of the outer tube.

3. The image forming apparatus according to claim 1, wherein the coupling guide mechanism includes:

a pair of guided plate pieces provided in parallel with each other on a peripheral surface of the outer tube to extend downward in a tangential direction to the peripheral surface; and a pair of guide members provided to the apparatus main body to guide a movement of the pair of guided plate pieces when the toner container is attached and detached in the radial direction of the rotating shaft.

4. The image forming apparatus according to claim 1, further comprising:

a locking structure provided to lock the toner container in a loaded state in the apparatus main body.

5. The image forming apparatus according to claim 1, wherein:

the rotating shaft is a rotating shaft of a stirring member that stirs the developer.

6. An image forming apparatus, comprising:

an apparatus main body;

a developing device installed inside the apparatus main body;

a toner container provided attachably to and detachably from the apparatus main body to replenish the developing device with a developer;

a rotating shaft installed in the toner container to be rotatable;

a first joint member provided on one of end portions of the toner container and coupled to the rotating shaft;

a second joint member provided to the apparatus main body oppositely to the first joint member;

a coupling guide mechanism that couples the first and second joint members to each other; and a driving source equipped to the apparatus main body to generate a specific driving force, wherein:

the driving force of the driving source is transmitted to the first joint member via the second joint member while the first and second joint members are coupled to each other by the coupling guide mechanism;

the coupling guide mechanism couples the first joint member and the second joint member to each other whether the toner container is loaded into the apparatus main body in an axial direction or in a radial direction of the rotating shaft;

the first joint member includes a coupling key provided to protrude outward in the axial direction from an end face of the rotating shaft; and the second joint member includes:

a tube couple concentrically to a driving shaft of the driving source to be integrally rotatable; and a key hole provided concavely to the tube in a surface opposing the end face of the rotating shaft into which the coupling key is fit to be integrally rotatable; and the coupling guide mechanism includes:

a pushing member that pushes the tube toward the first joint member along the driving shaft; and a pressing piece including an inclined surface configured to interfere with the tube so that the tube is moved in a direction opposite to a pushing direction by the pushing member when the first joint member and the second joint member are coupled to each other in a case where the toner container is loaded into the apparatus main body from the radial direction of the rotating shaft.

7. The image forming apparatus according to claim 6, wherein:

the first joint member further includes an outer tube formed on a housing of the toner container, on which an end portion of the rotating shaft is internally fit so as to be rotatable relatively to each other, the coupling key being accommodated in an internal space of the outer tube;

the tube of second joint member is an inner tube coupled concentrically to a driving shaft of the driving source to be integrally rotatable, on which the outer tube is concentrically and externally fit so as to be rotatable relatively to each other;

the inclined surface configured to protrude outward in the radial direction from a peripheral surface of the outer tube and incline from a tip end edge toward a base end of the outer tube; and the inner tube fits in the outer tube after having passed by the inclined surface.

* * * * *